US006224516B1

(12) United States Patent
Disch

(10) Patent No.: US 6,224,516 B1
(45) Date of Patent: May 1, 2001

(54) OFFICE AND WORK FURNITURE

(76) Inventor: Georg Disch, Lettenweg 13, 79618 Rheinfelden (DE)

( * ) Notice: Subject to any disclaimer, the term of this patent is extended or adjusted under 35 U.S.C. 154(b) by 0 days.

(21) Appl. No.: 08/995,740

(22) Filed: Dec. 22, 1997

(51) Int. Cl.[7] ..... A63B 22/00
(52) U.S. Cl. ..... 482/54; 482/51
(58) Field of Search ..... 482/51, 52, 54

(56) References Cited

U.S. PATENT DOCUMENTS 5,743,833 * 4/1998 Watterson et al. ..... 482/54
5,813,947 * 9/1998 Densmore ..... 482/54

* cited by examiner

*Primary Examiner*—Glenn E. Richman
(74) *Attorney, Agent, or Firm*—Henry M. Feiereisen

(57) ABSTRACT

The invention relates to office and work furniture with a table top or work bench top and a support frame supporting the top, where+in the support frame is supported on the floor by at least two legs or at least one support surface. A treadmill exercising device in the form of a moveable continuous conveyor belt is stored in its rest position inside the three-dimensional space of the treadmill exercising device, from which rest position the device can be moved or tilted into the operating position on the floor in front of the table top or work bench top and locked in place. The treadmill exercising device includes at least one support frame and a continuous conveyor belt guided over to deflection rolls which are supported in the support frame. The conveyor belt is constructed from rubber or from lamellar elements. The support frame is enclosed by side covers and provided with slider or roller elements.

40 Claims, 20 Drawing Sheets

A
B
B'
Z
FR
BU
P1
P2
P3
9
10
11
12
2
3
24
32

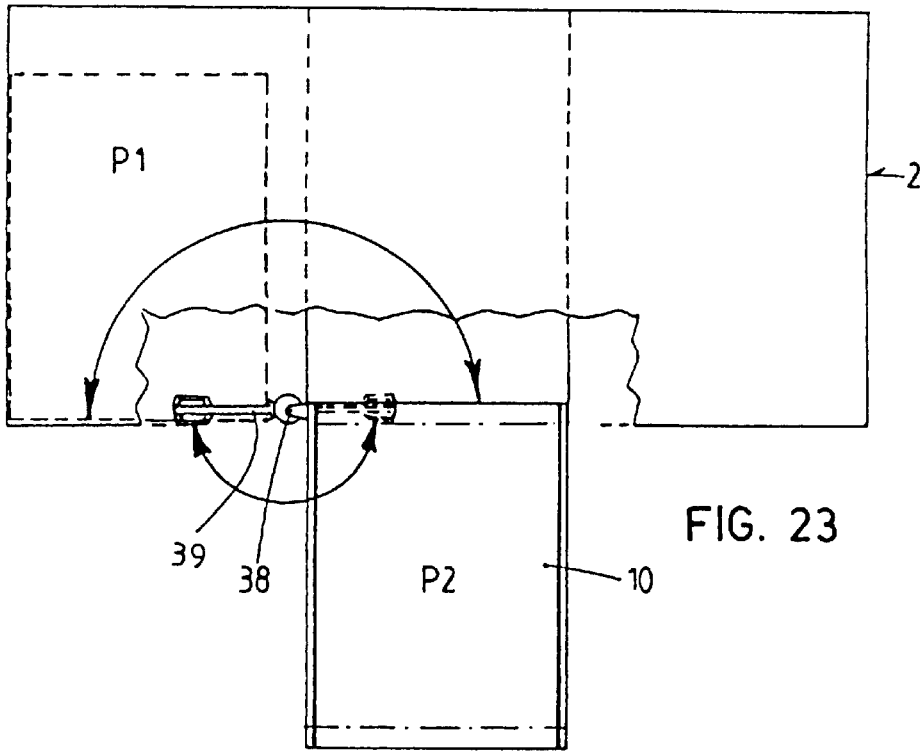
FIG. 23
FIG. 24
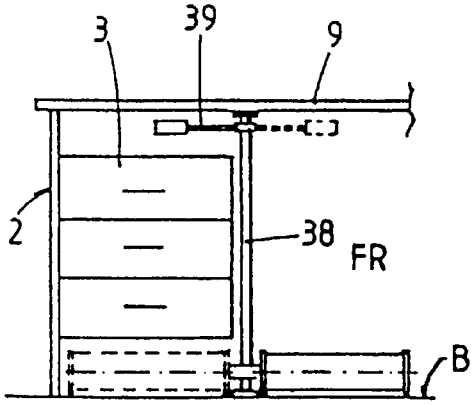
FIG. 25
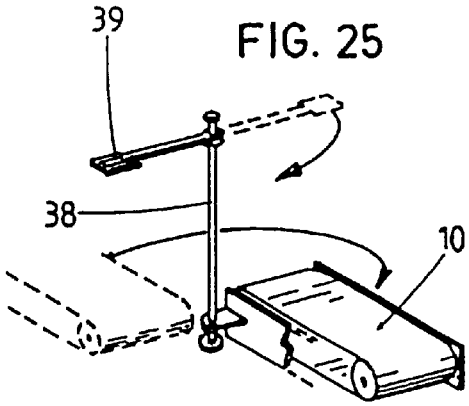

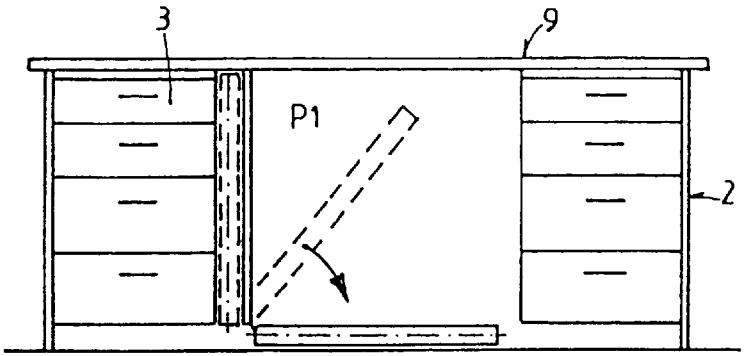
FIG. 28
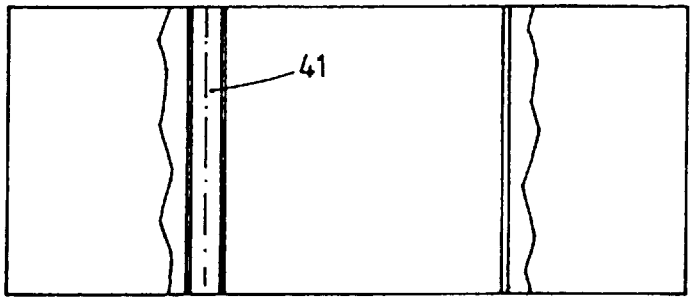
FIG.29
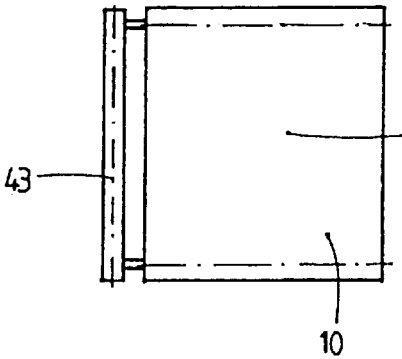
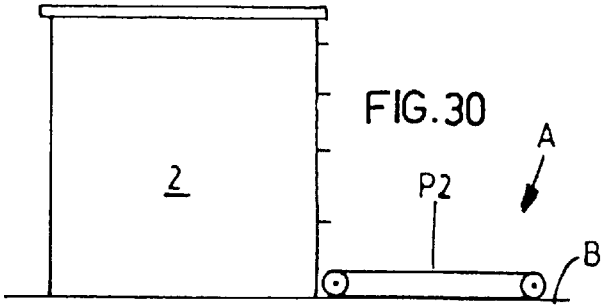
FIG.30
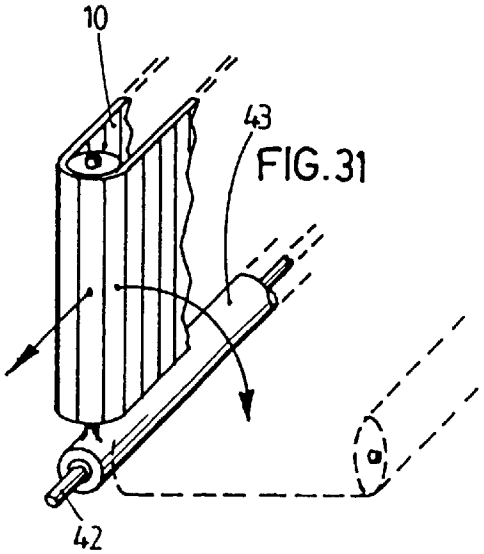
FIG.31
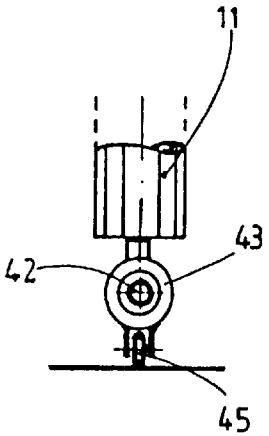
FIG.32

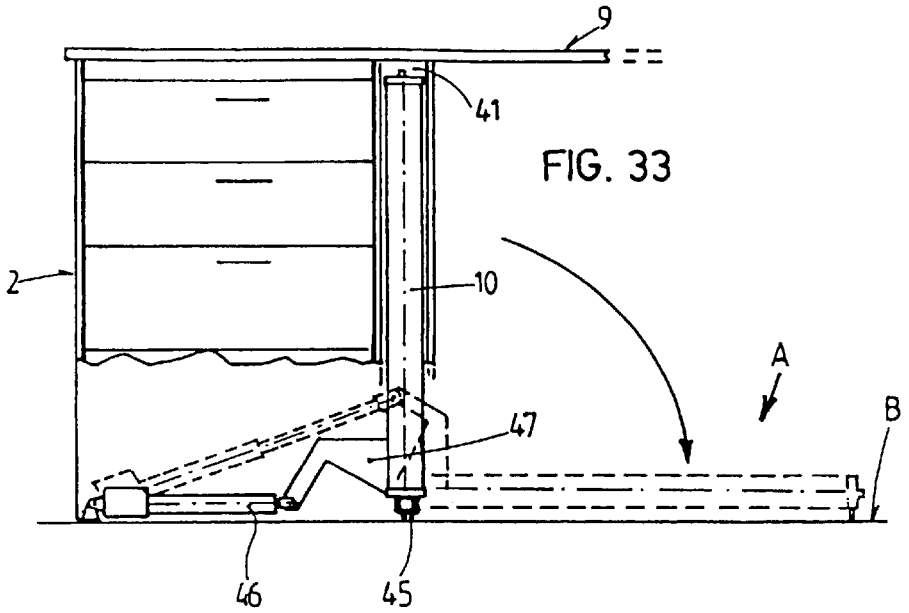
FIG. 33
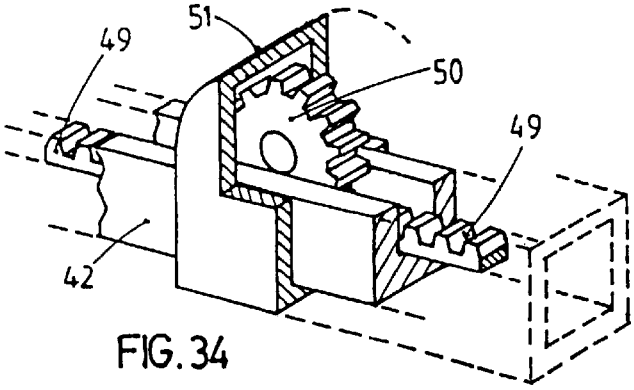
FIG. 34
FIG. 35
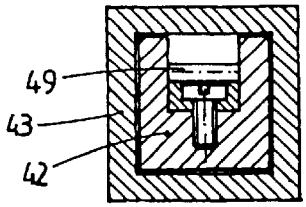
FIG. 36
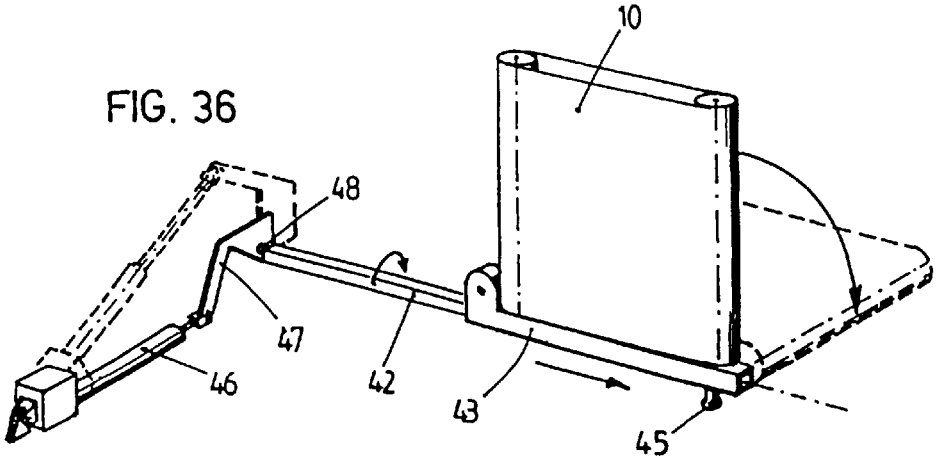

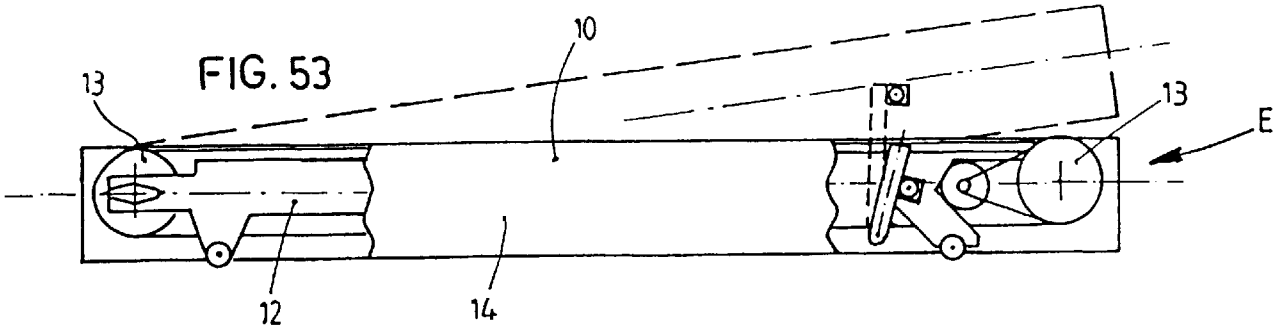
FIG. 53
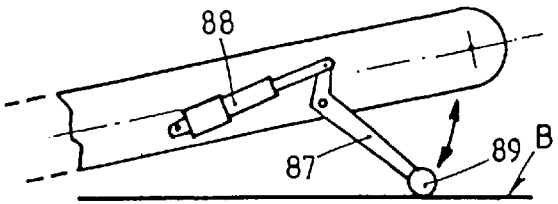
FIG. 56
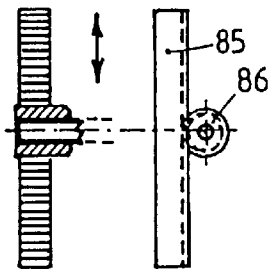
FIG. 55a/b
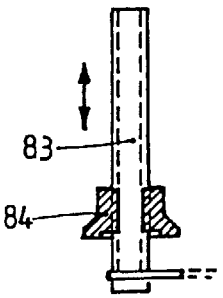
FIG. 54
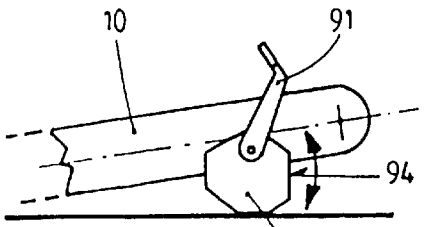
FIG. 58
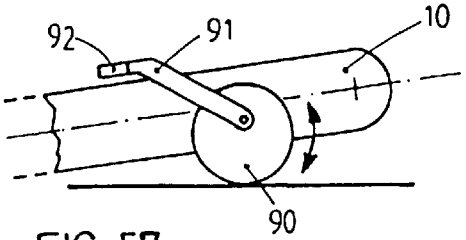
FIG. 57

FIG. 61
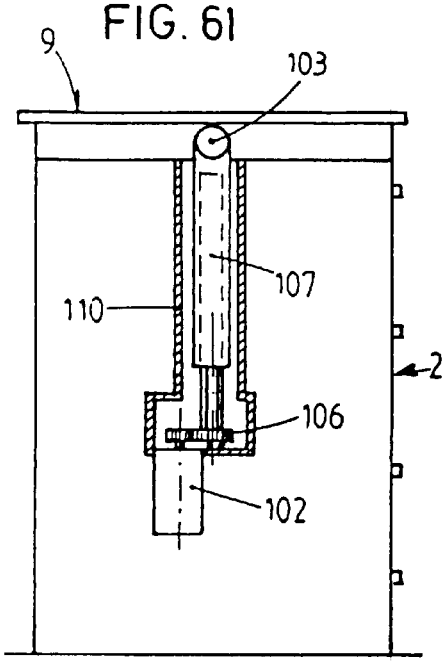
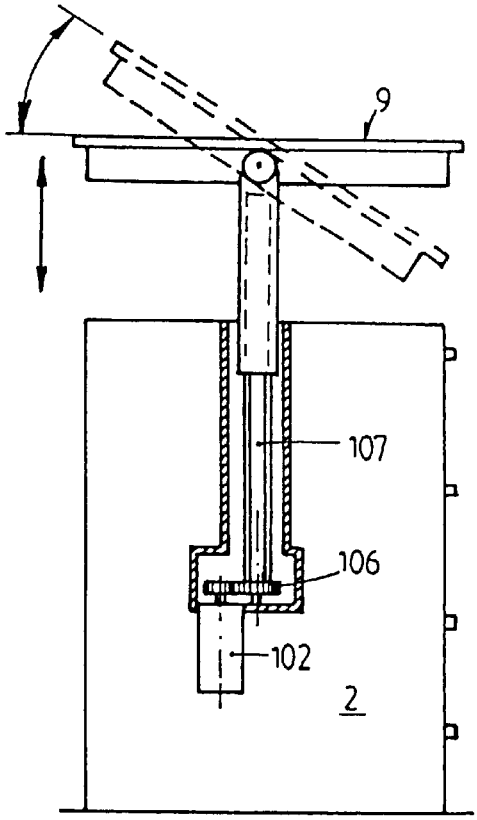
FIG. 62
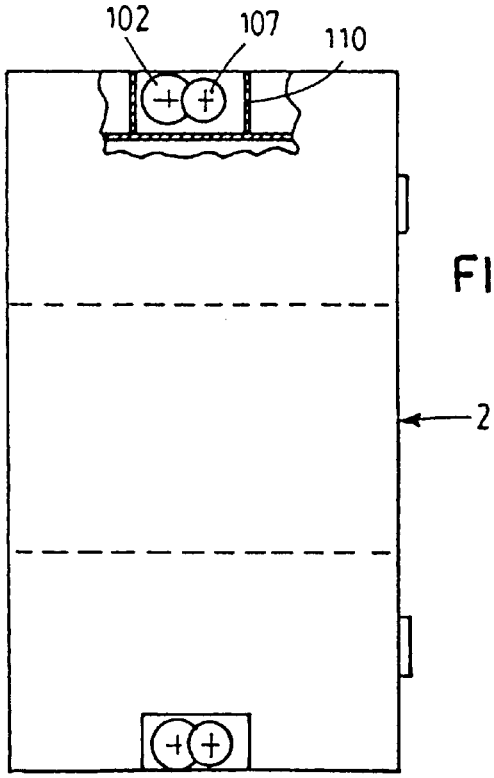
FIG. 63

OFFICE AND WORK FURNITURE

DESCRIPTION

The invention relates to office and work furniture with a table top or work bench top and a support frame supporting said top, wherein the support frame is supported on the floor by at least two legs or at least one support surface.

Office and work furniture oft his type is known in a number of variations and designs, including special designs for different office tasks, e.g. as drawing tables, standing desks, and in particular also as desks for computer workstations. Also known in the art is special furniture for teller stations and counters in banks, post offices, railway stations, etc., which can be arranged side by side in the form of rows and positioned in a straight line or a curved pattern.

Moreover, similar workplace furniture of conventional or special design is known in the art for carrying out manual work, for example for watchmakers, opticians or precision mechanics, also for sewing and pressing, or for manual work in general.

Based on office and work furniture of this type, it is the object of the invention to provide exercise opportunities people working at these workplaces to exercise their leg muscles so that this leg exercise can also be performed during working hours or during shorter or longer work breaks, for example when waiting until new documents or information arrive, or also during other planned short work breaks.

The object of the invention is solved with respect to such office and work furniture in that a treadmill exercising device which has the form of a moveable continuous conveyor belt is disposed in a rest position within the three-dimensional space defined by the furniture, and that the treadmill exercising device can be moved and/or tilted into its operating position on the floor in front of the table top or work bench top and locked in this position.

By combining the exercise device with a office and work furniture of this type, the exercise device with a moveable continuous conveyor belt can have wide ranging applications in offices and shops and also in private households. More particularly, the invention can aid significantly in improving the fitness of persons at their workplace, since the lower body muscles can be exercised not only during brief work interruptions but also during the work. This invention advantageously supports the daily exercise needs of people working in a sitting or standing position while taking up little space. The exercise device can also be fitted in a manner known in the art with a recording device for recording the duration of and the performance during the running exercise.

A treadmill exercising device adapted for this purpose can advantageously include a support frame and a continuous conveyor belt guided by two deflection rolls supported in the support frame, wherein the continuous conveyor belt can be constructed from rubber or from lamellar elements. In addition, at least one of the deflection rolls of the treadmill exercising device can include a motor drive which can be an electric motor disposed within the support frame and a transmission device for transmitting the torque to the drive shaft of the deflection roll.

In the region between the deflection rolls of the upper run of the conveyor belt, the device is advantageously provided with support elements for the conveyor belt, which preferably has a flat non-slip support surface with a slideway lining. For improving the belt movement, rotatable rolls distributed across the area can be supported in the support surface; the RPM of the motor drive is preferably adjustable. The support frame which is laterally enclosed by side covers, can include slider or roller elements.

The significant features of the invention are related to the various possibilities for arranging or placing the treadmill exercising device in spatial relationship inside of or proximate to office and work furniture so that the worker is not interrupted in his/her normal and task-oriented work when the exercise device is not in use. This significant object of the invention can be solved in many different ways.

With office furniture having the form of a standing desk with a table top or work bench top which is fixed or which can be raised and lowered and tilted, the treadmill exercising device in the standing desk can be pulled or moved out of the rest position near a bottom region on the floor and placed into the operation position in front of the furniture. The treadmill exercising device can be pulled out manually, in particular if the treadmill exercising device is provided with slider or roller elements.

In an advantageous embodiment, a motor-driven horizontal displacement device can be placed in the bottom region of the standing desk and connected to the treadmill exercising device for moving the treadmill exercising device between the rest position and the operating position by remote control. This is accomplished with a horizontal displacement device comprising toothed rails attached on both sides in the bottom region and cooperating with the motor-driven toothed pinions supported on the treadmill exercising device.

In another modified embodiment, the horizontal displacement device is disposed on both sides in the bottom region and includes motor-driven continuous traction means guided over deflection rolls, wherein the treadmill exercising device is releasably connected to the lower run of the continuous traction means through a rib.

In another embodiment of the horizontal displacement device, the horizontal displacement device is a linear motor or a hydraulic piston actuator.

A group of office and work furniture in the form of a writing desk, which can also have a table top or work bench top which is fixed or which can be raised and lowered and tilted, and wherein the desk can also include a foot space and a container disposed on one side or on both sides of the foot space, the treadmill exercising device can initially be pulled out from its rest position underneath the container, where the device is guided in lateral guides in the bottom region on the floor, and displaced into a ready position in front of the container, and by subsequently displaced transversely from the ready position into the operating position midway in front of the table top or work bench top.

With this arrangement and design, the user of the treadmill adapted for the writing desk can move the device from the rest position into the operating position with two simple manipulations.

In a significant improvement, the treadmill exercising device can be moved transversely in the lateral guides from the rest position into a ready position with the help of a motor-driven transverse displacement device and subsequently moved longitudinally from the ready position into the operating position with the help of a motor-driven longitudinally displacement device.

By driving the two displacement operations with motors, the user working at the desk can move the treadmill exercising device into the operating position at the workplace and exercise his/her legs while standing up. If the worker wishes to continue his/her work, the worker can also move the height-adjustable table top or work bench top into the proper height and/or tilt position with a motor drive by pushing a button.

In yet another modification of this embodiment, the treadmill exercising device can be tilted by 180° about a vertical axis from its rest position underneath the container in the bottom region into the horizontal operating position with the help of a tilting device. In a preferred arrangement, the lower portion of treadmill exercising device is prevented from rotating from its rest position underneath the container by being connected to a tiltable vertical drive shaft which is rotatably secured to the writing desk, thereby enabling the treadmill exercising device to be manually rotated with a handle about 180° between the rest position and the operating position and vice versa.

With this advantageous and simplified construction of the device, the device can be moved into the operating position with just a single manipulation. According to another feature of the invention, the drive shaft is operatively connected to the tilt motor via a transmission, thereby enabling remote control by pushing a button.

According to a further advantageous embodiment, the treadmill exercising device can be moved from its rest position inside a vertical receiving pocket disposed on the side of the container facing the foot space, into the operating position by pulling the treadmill exercising device out towards the front and rotating the treadmill exercising device about 90° onto the floor. In the rest position, the treadmill exercising device is advantageously unobtrusively located to the side of the foot space, from where the device can be pulled out and rotated with just two manipulations.

In an improved design offering enhanced comfort, the support frame of the treadmill exercising device is advantageously connected to a sliding bushing capable of sliding on a guide rod secured to the writing desk and traveling on the floor with the help of an arrangement of rollers; the sliding bushing can be rotated together with the treadmill exercising device from the vertical rest position into the horizontal position on the floor, i.e. assuming the operating position. This feature facilitates handling of the device and moving the device into the operating position.

In still another advantageous embodiment, a motor-driven pinion which is supported in a housing on the sliding bushing, engages with teeth disposed on the guide rod, while the guide rod which is rotatably supported in the lower section of the receiving pocket, can be rotated from the vertical rest position of the treadmill exercising device into the horizontal operating position with the help of a lever connected to the guide rod and a linear motor or a hydraulic drive engaging the drive rod. With the motor drive, the operation can be completely automated, requiring only pushing of a button.

In another modification of this embodiment, a traction mechanism which is driven by a motor, can engage with the lever which is connected to the guide rod. The traction mechanism can be a tooth-type chain or a link chain drive.

By significantly modifying the features of the previous embodiment for moving the treadmill exercising device from the rest position into the operating position, the treadmill exercising device can be transposed from a rest position which is substantially vertical or slightly tilted from the vertical direction and located in the region of the foot space facing away from the workplace, into the operating position by sliding along guides which are disposed along a diagonally downwardly extending Y-axis. Both sides of the treadmill exercising device can also be connected in the region of the deflection roll to respective guide bushings which are slideably guided on respective rigid self-supporting rods arranged on the writing desk and forming the y axis.

The previous embodiment of the invention can be modified further by connecting both sides of the treadmill exercising device in the region of the deflection rolls to respective traction means which can be spooled onto reels disposed on a motor-driven shaft which is supported at the rear top of the free space. This type of actuation represents a practical and simple solution.

In a modification of this embodiment, the treadmill exercising device can be slideably guided on both sides by the guide bushings disposed on rods which are attached on both sides of the writing desk, whereby the treadmill exercising device can be lowered to or set on the floor by link chains or toothed traction means operated by motor-driven toothed drive wheels. The link chains or toothed traction means can preferably be secured to the guide bushings and conveyed to the drive wheels via guide rolls. In still another advantageous and simple embodiment, a continuous traction means is secured to the guide bushings and guided by guide rolls, wherein the traction means are looped around the motor drive rolls multiple times for transferring the torque.

In still another embodiment of the device, the Y axis can be formed by a ball spindle wherein the adjusting screw of the ball spindle is connected to the treadmill exercising device in the region of the axis of a deflection roll, with the ball spindle connected to a drive motor via a transmission.

In a particularly preferred embodiment of the treadmill exercising device having several features known in the art, the drive motor of the device is located in one of the deflection rolls, driving the deflection rolls directly. Advantageously, the stator is herein secured to the support frame with a stationary stator bolt, while the rotor shaft is non-rotatably secured to a clutch drive ring which is clamped inside the cylindrical inner space of the roll.

Another advantageous feature for the user is that the treadmill exercising device can be raised continuously or step-wise into an inclined position having an angle of up to 15° by raising the end pointing in the running direction. For raising the end of the treadmill exercising device pointing in the running direction, there are provided on both sides of the treadmill exercising device articulated, rotatably supported threaded spindles which are supported on the floor and which can be rotated either manually or with a motor, wherein the threaded nuts of the spindles are flexibly connected to the support frame. In an alternate design, the end of the treadmill exercising device pointing in the running direction can be raised with a pair of rack/pinion assemblies having toothed racks which are disposed on each side of the treadmill exercising device and supported on the floor, and manually operated or motor-driven pinion units which are flexibly supported on the support frame and are guided longitudinally on the toothed racks.

With modified features for raising the treadmill exercising device, the treadmill exercising device is raised with the help of double levers which are pivotally supported on both sides of the support frame, with the upper lever arms of the double levers flexibly coupled to hydraulic piston actuators or linear motors, and with the lower lever arms of the double levers supported on the floor by slider elements.

Advantageously, the arrangement for raising the end of the treadmill exercising device pointing in the running direction can be simplified considerably by incorporating eccentric support rolls which are rotatably supported on both sides of the support frame and which are provided with an upwardly pointing lever with a handle and supported on the floor. This arrangement can be improved further in that the eccentric support rolls are in the form of discs with at least three polygonal support surfaces. This arrangement obviates precautionary measures to prevent the device from rolling away.

As mentioned before, the user using the treadmill exercising device at the workplace should have the opportunity to exercise his/her legs with the device while standing up. When using the device, the work at the desk or any other work, e.g. reading or arranging documents or writing, should preferably not be interrupted, but should rather continue. For this purpose, the office and work furniture is equipped with a table top or work bench top which can be raised and lowered and/or tilted. This lifting and tilting feature can advantageously be implemented by connecting both sides of the table top or work bench top through a linkage to respective toothed lifting rods which cooperate with respective pinions and a lifting motors driving the pinions. In another modification of this embodiment of the lifting and tilting features, both sides of the table top or work bench top can be connected through linkages to respective piston rods of hydraulic piston actuators. In yet another modified embodiment, both sides of the table top or work bench top can be connected through linkages to respective spindle drives and lifting motors associated with the spindle drives.

In another embodiment of the office and work furniture in the form of a writing desk, the desk is provided with a foot plate located underneath the foot space for enclosing the foot space at the bottom, wherein the walls of the writing desk form the bounds on both sides of the container to the inside and extend into a recessed space below the floor level and comprise guides for moving a cover plate therein. The user has access to the treadmill exercising device by pushing back the cover plate.

The concept of the invention can also be applied to counters for public transactions, teller windows in post offices, banks and railway stations, etc., in that the counter is in the form of a counter for public transactions with a counter front and counter spaces, wherein a free space is partitioned off in the lower section of each counter space below a cover plate, wherein the free space can receive a portion of the treadmill exercising device which is placed on the floor in the area of the respective work place.

The office and work furniture of the invention is not restricted to specific forms or designs. To the contrary, almost all models of office and work furniture presently in use can be combined with the treadmill exercising device in the manner described above. Particularly suitable designs are, for example, writing desks and tables which have a table top and are equipped with boxes or containers having drawers or compartments arranged underneath the table top.

Embodiments of the invention are described in detail hereinafter with reference to the appended drawings, in which.

Figure 1:
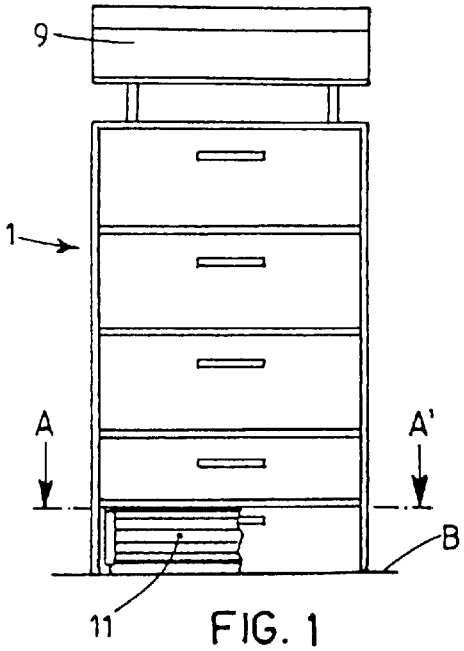
FIG. 1 is a front view of a standing desk.
Figure 2:
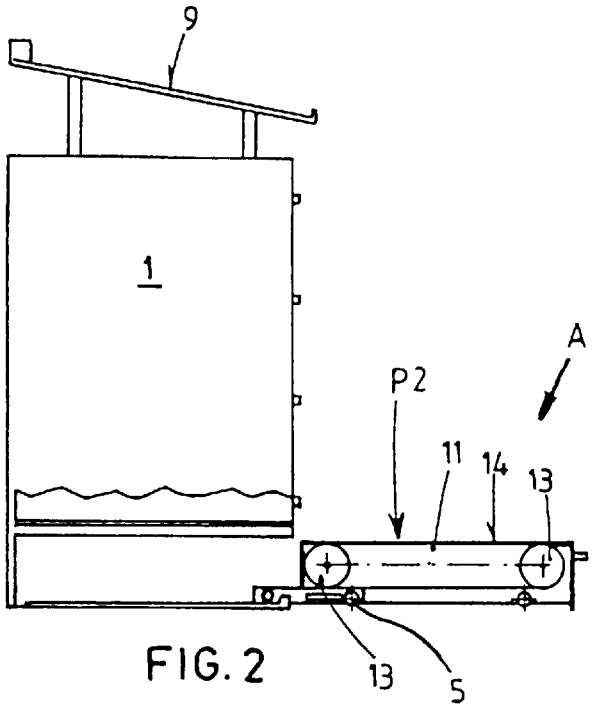
FIG. 2 is a side view with partial section according to FIG. 1.
Figure 3:
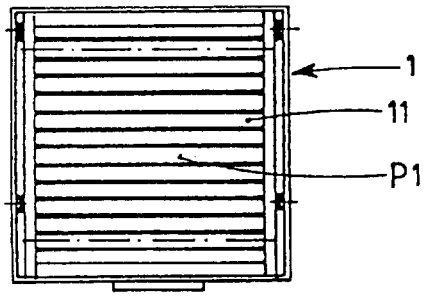
Figure 5:
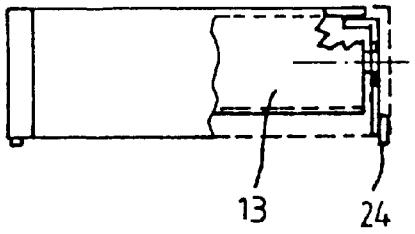
Figure 7:
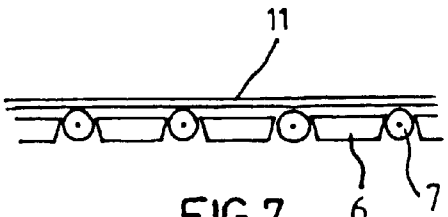
Figure 4:
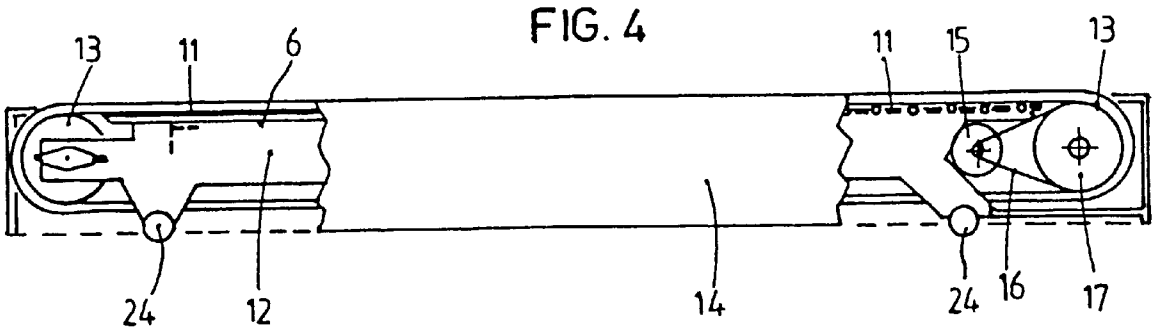
Figure 6:
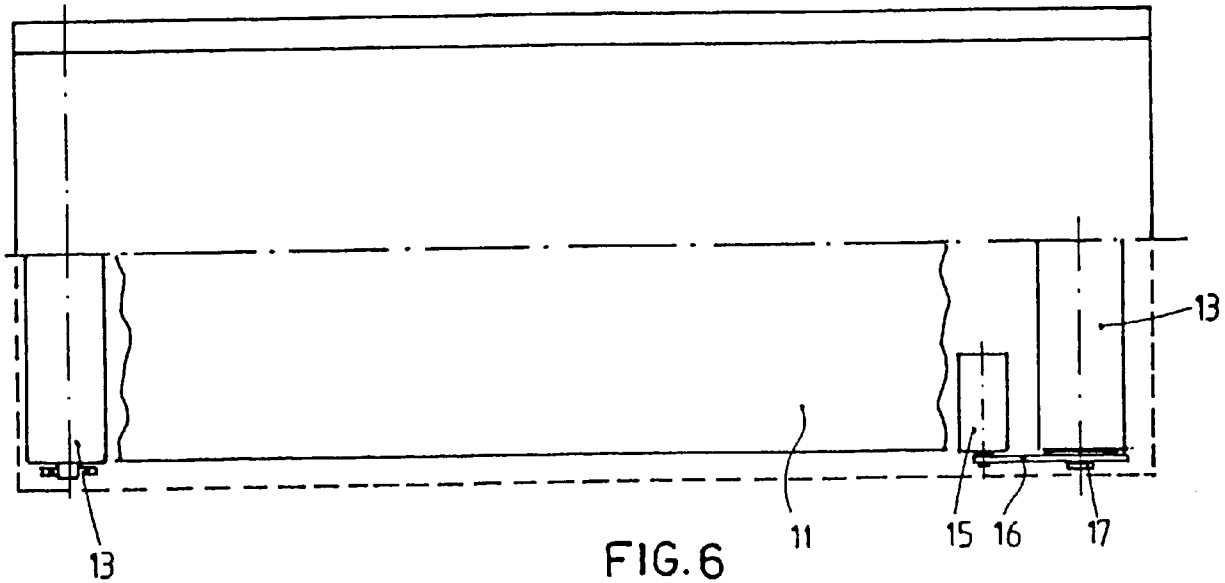
Figure 8:
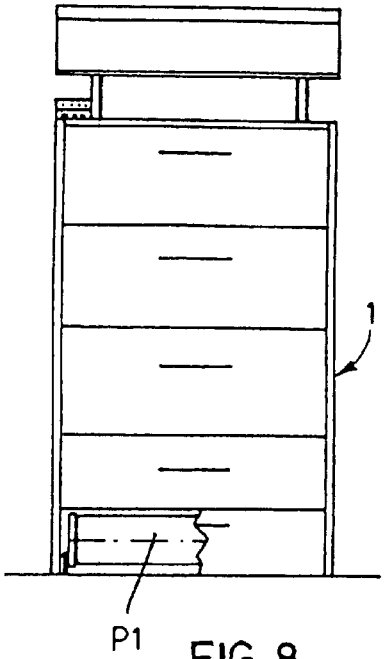
Figure 9:
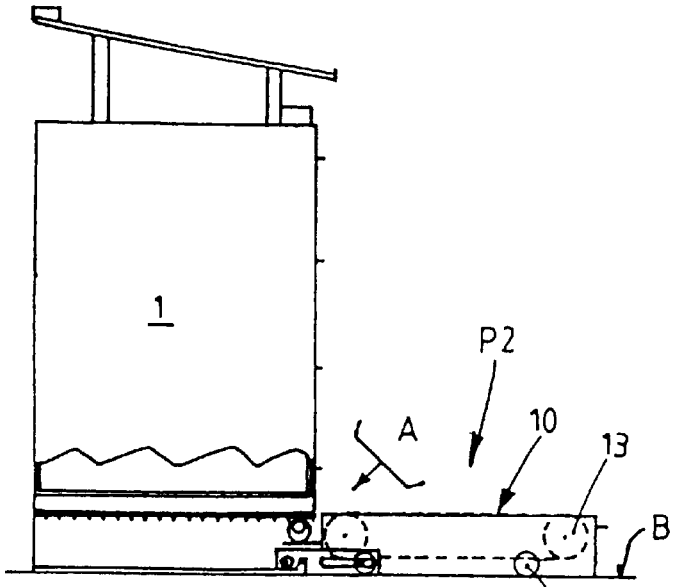
Figure 11:
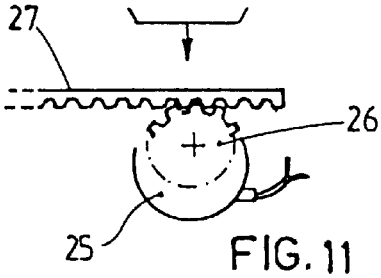
Figure 10:
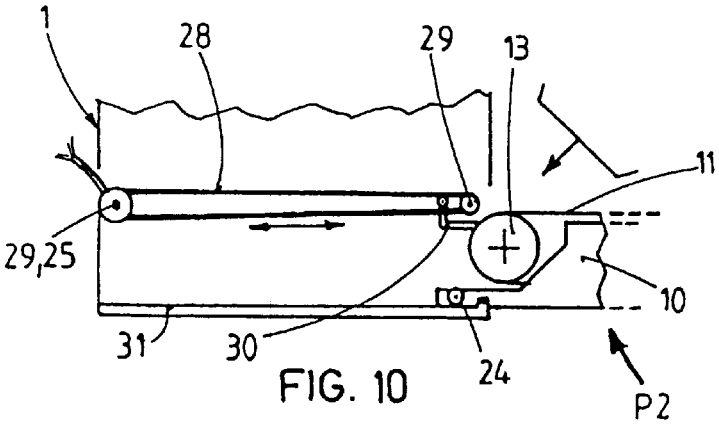
Figures 12, 13, 14, 15, 16:
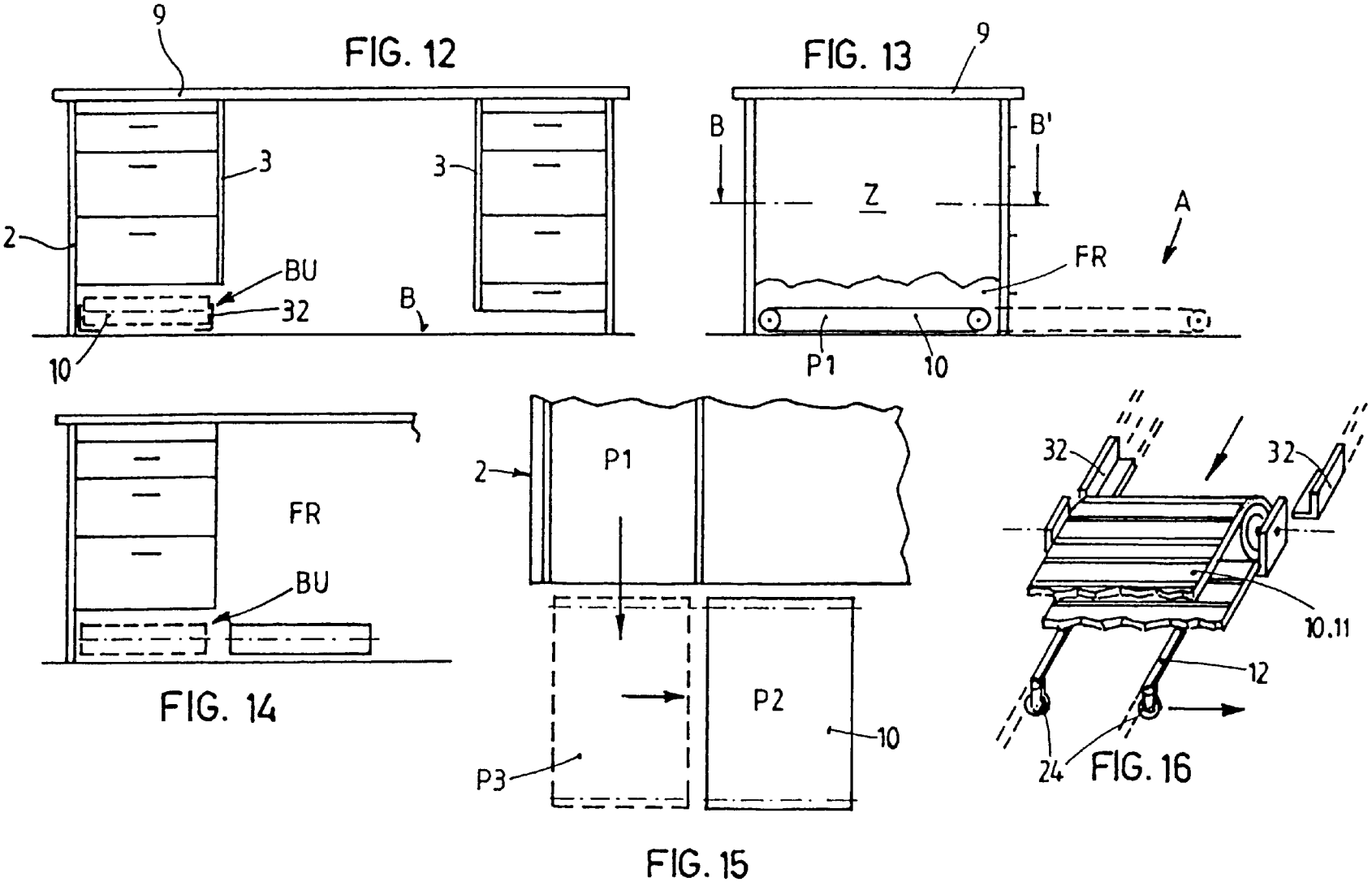
Figure 17:
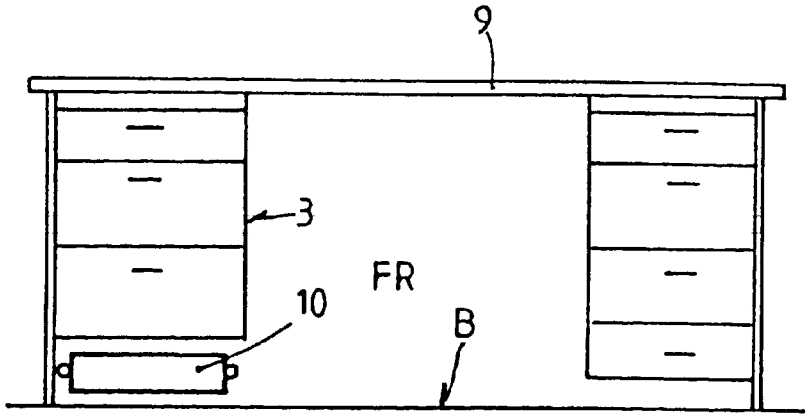
Figure 18:
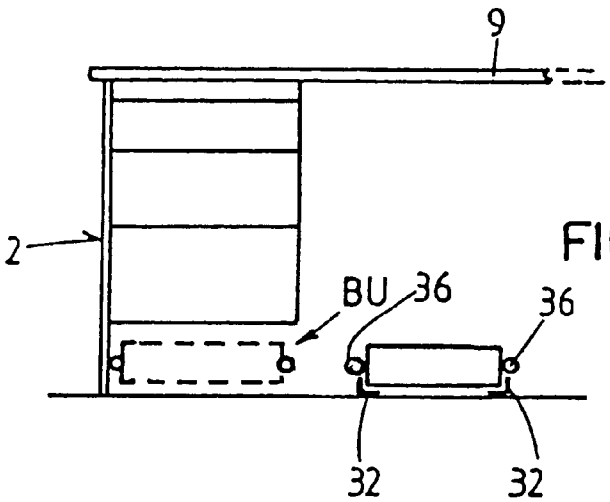
Figure 19:
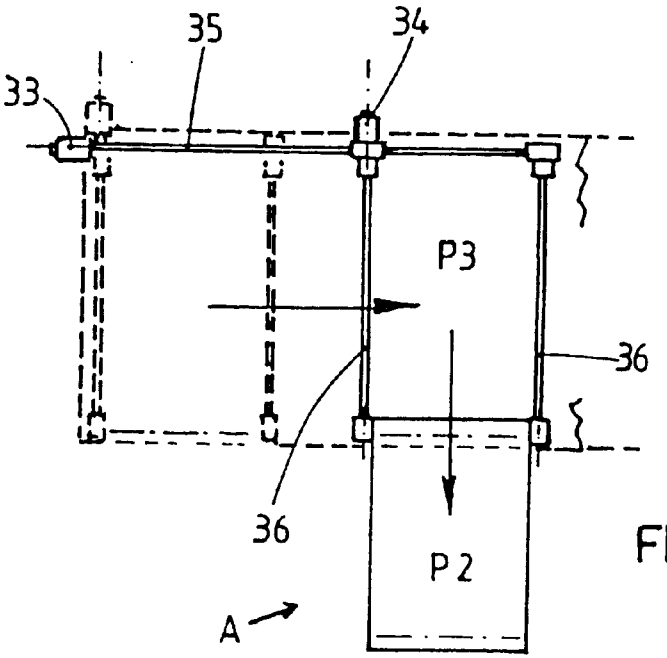
Figure 20:
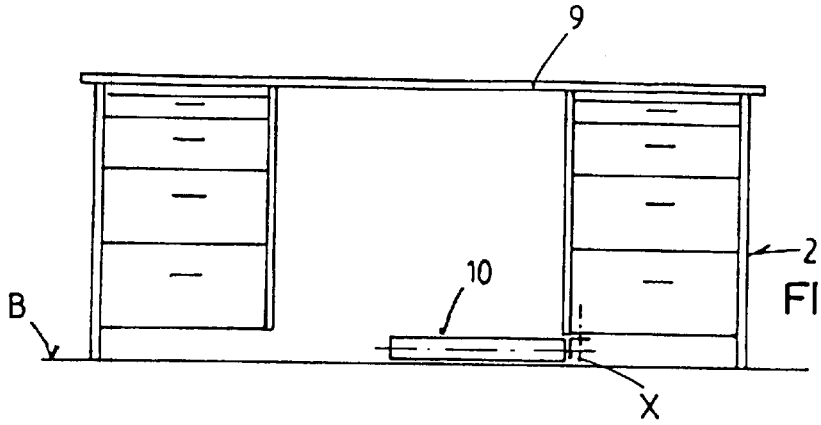
Figure 21:
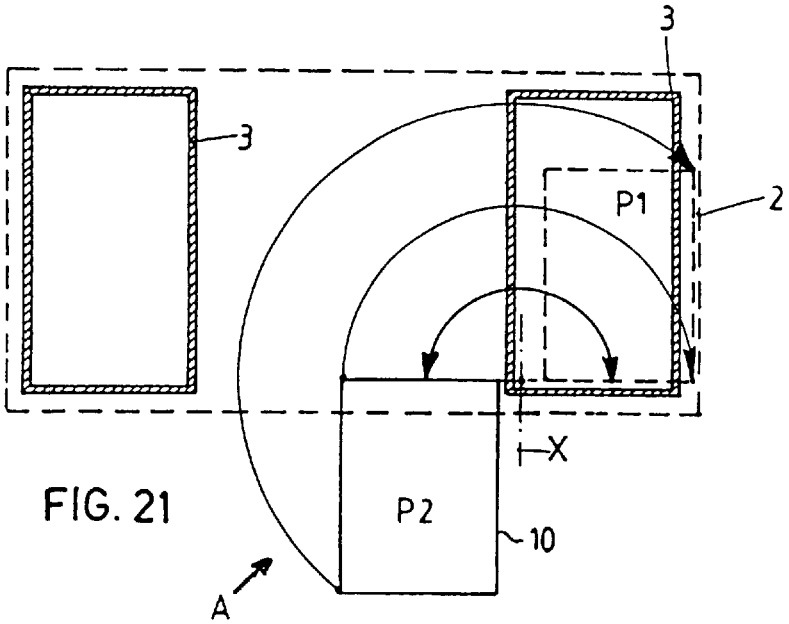
Figure 22:
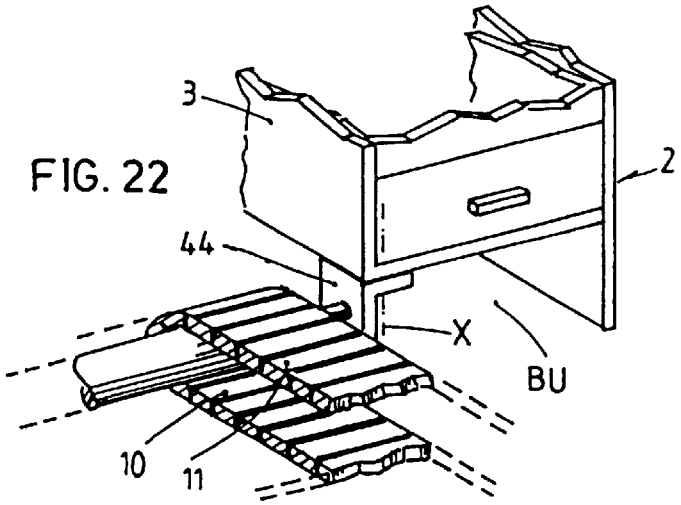
Figure 26:
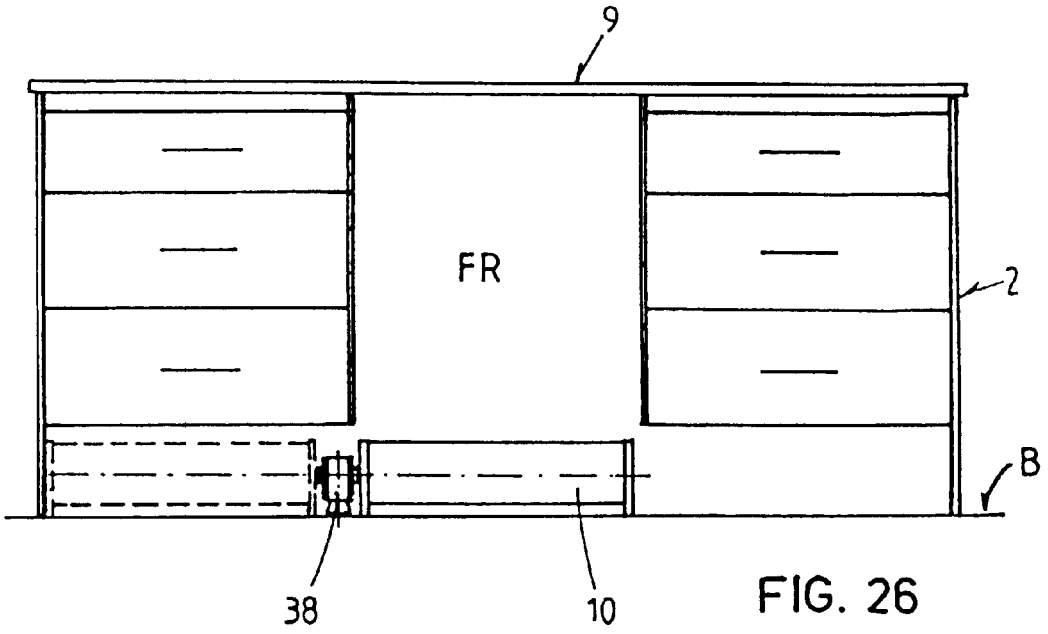
Figure 27:
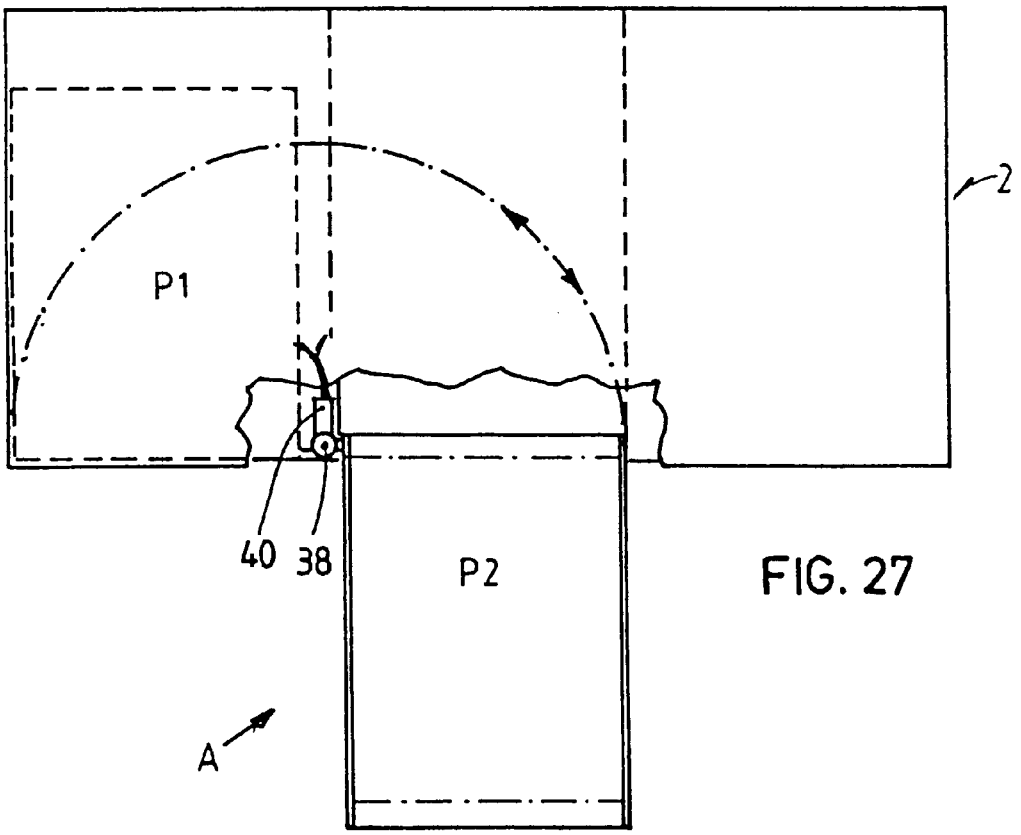
Figure 37:
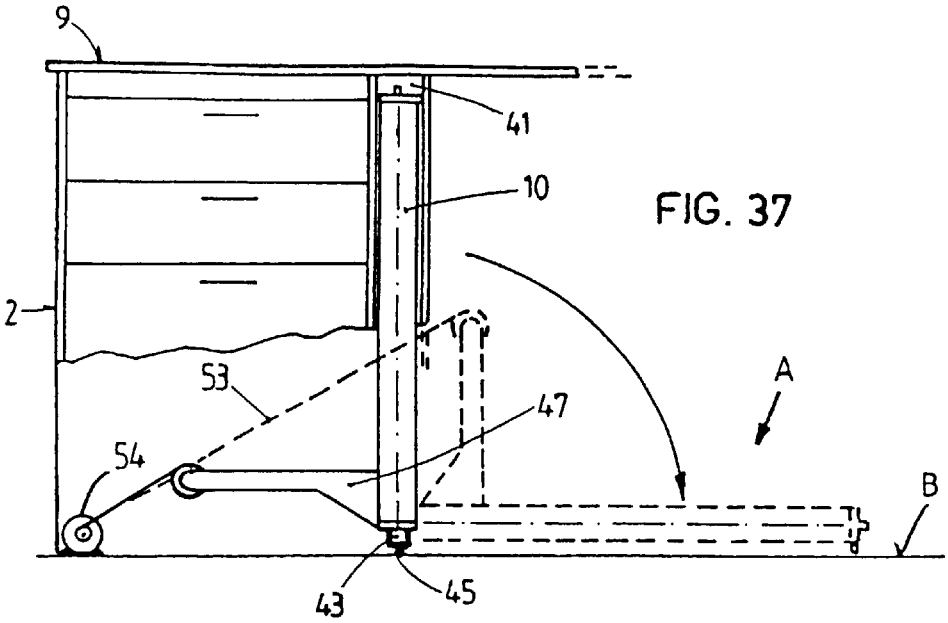
Figure 38:
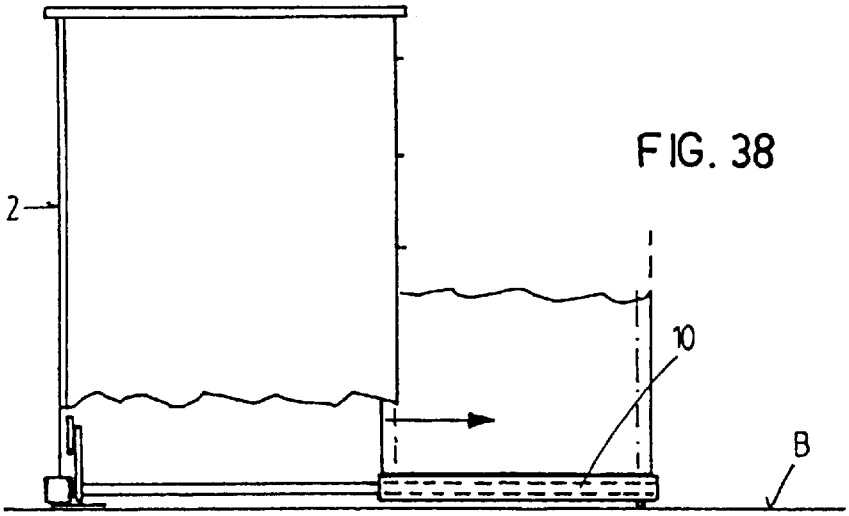
Figure 39:
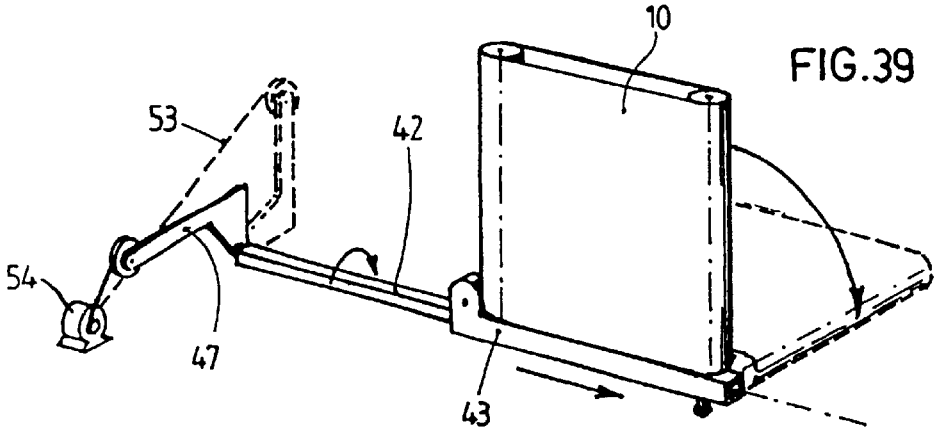
Figure 40:
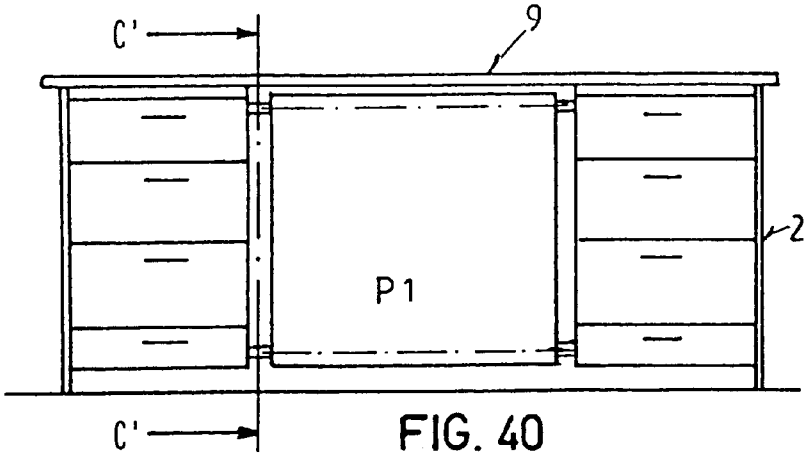
Figure 41:
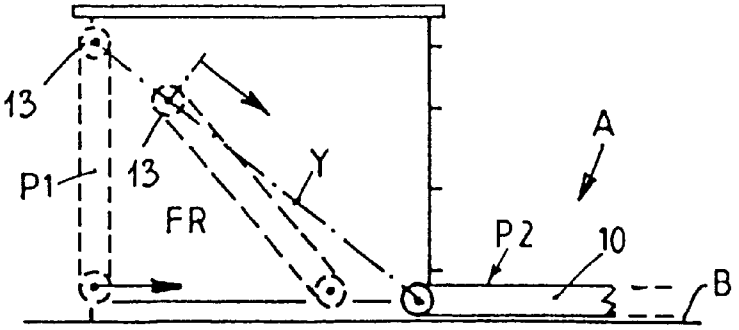
Figure 43:
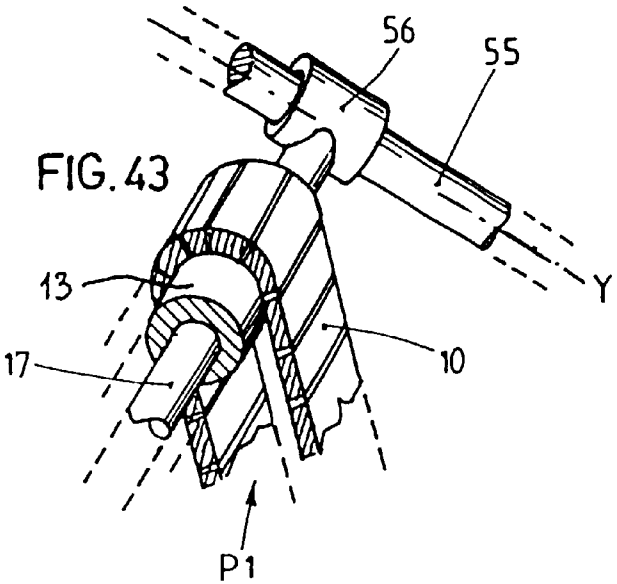
Figure 42:
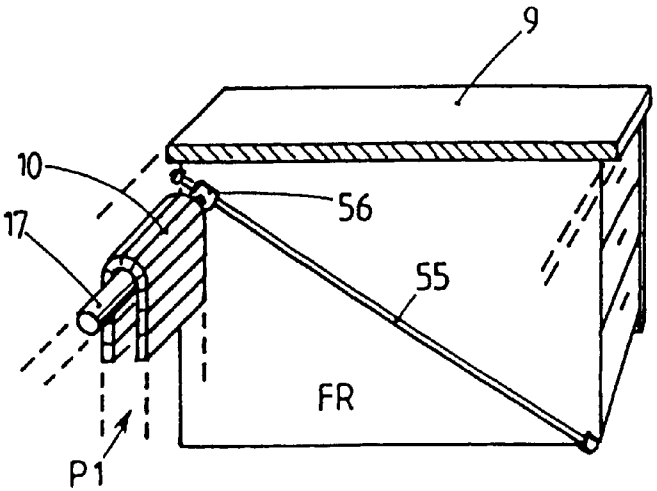
Figure 45:
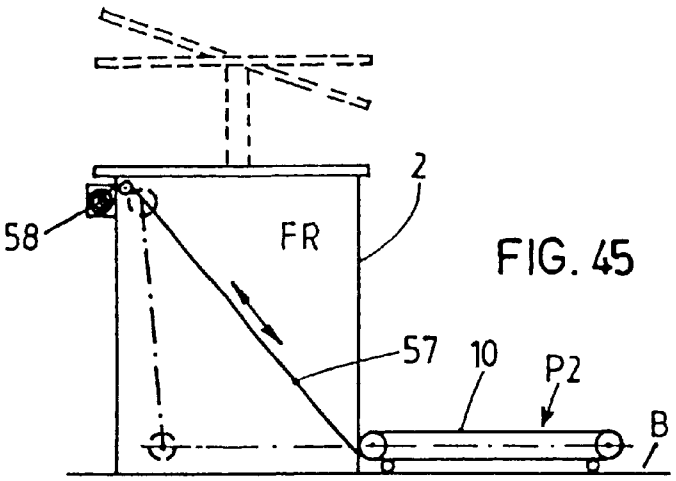
Figure 46:
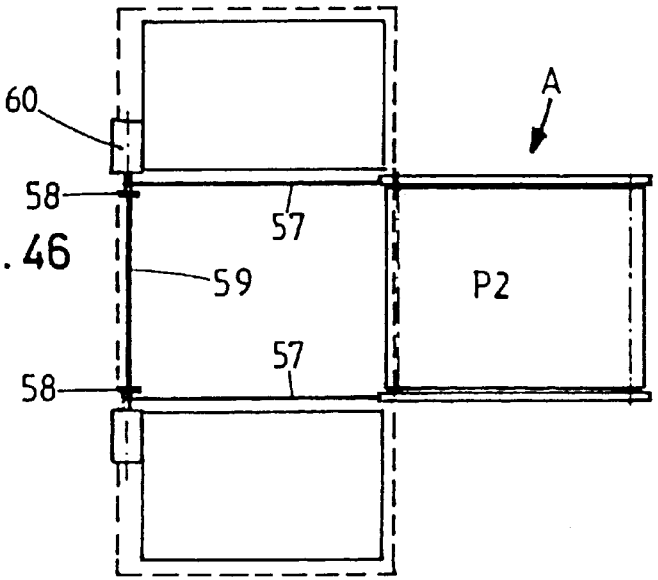
Figure 44:
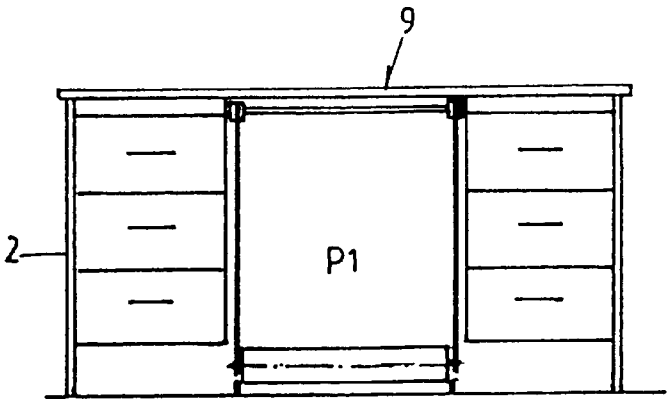
Figure 47:
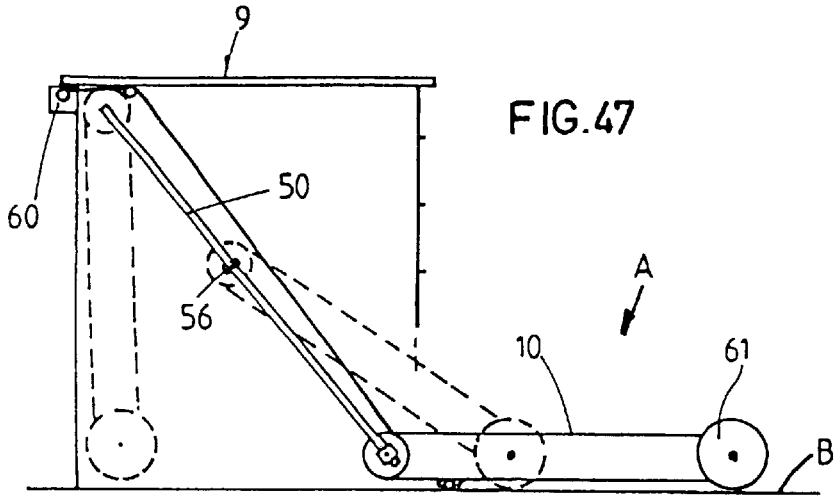
Figure 48:
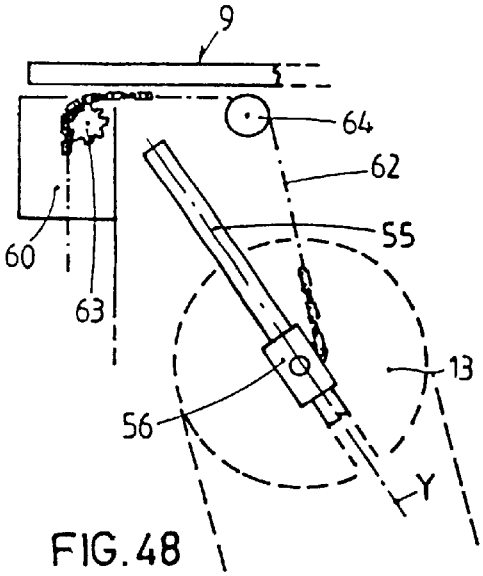
Figure 49:
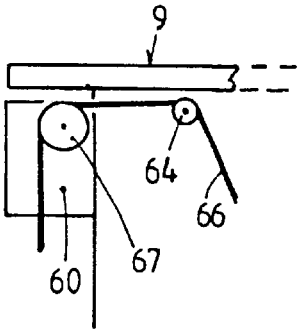
Figure 50:
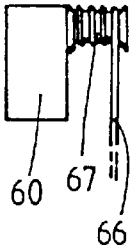
Figure 51:
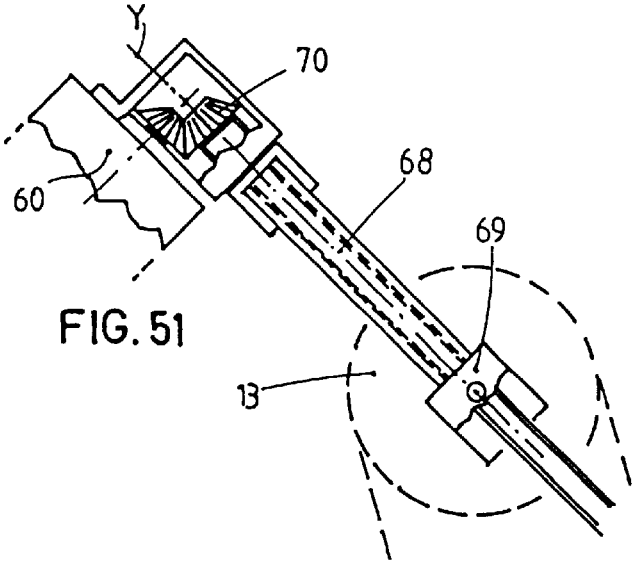
Figure 52:
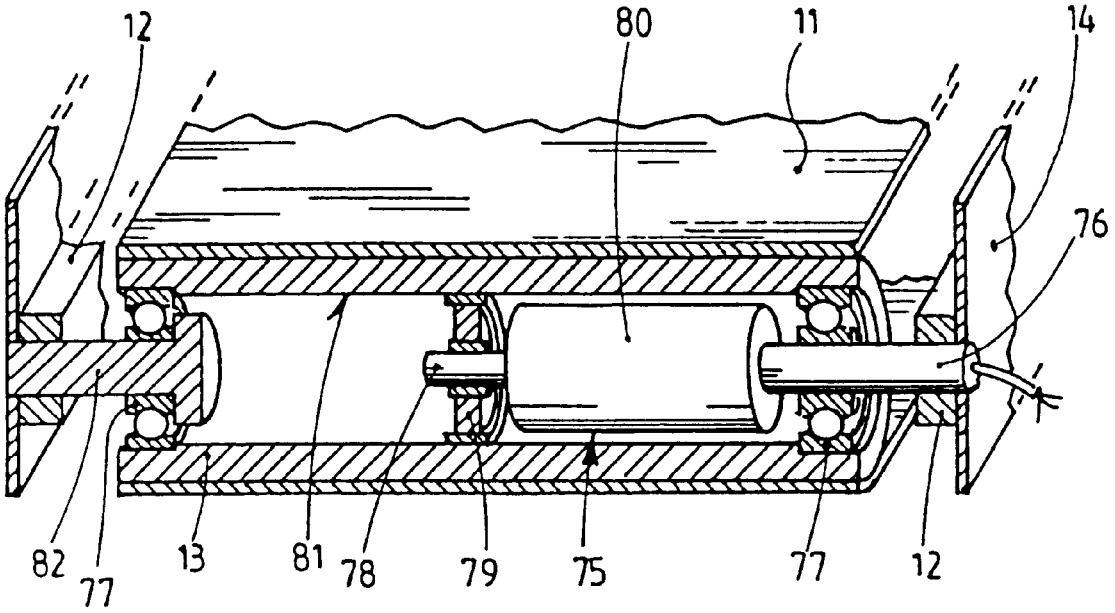
Figure 59:
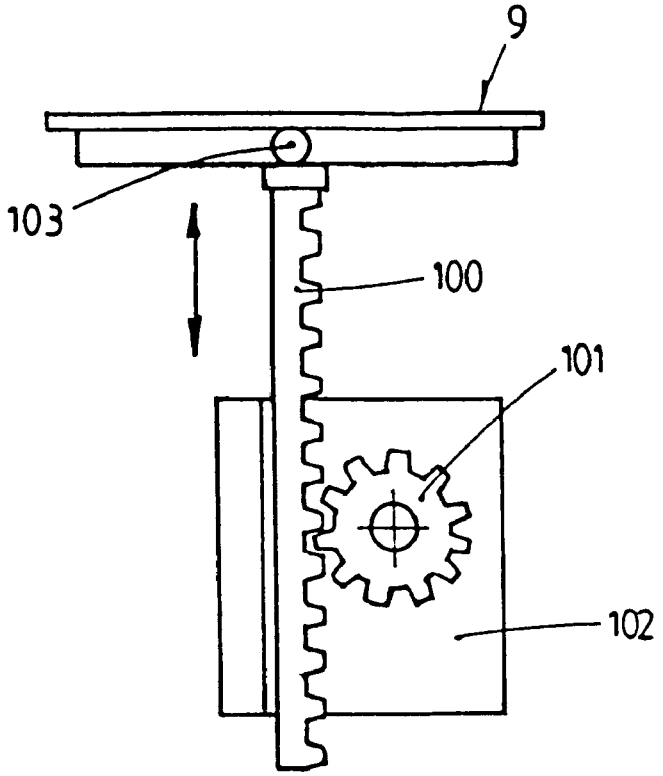
Figure 60:
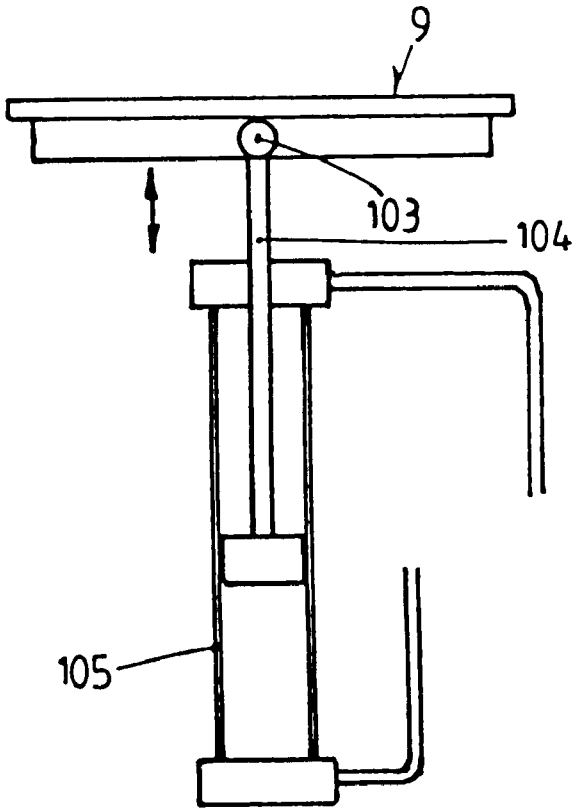
Figure 64:
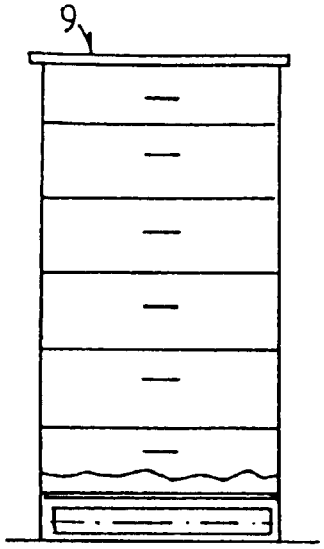
Figure 65:
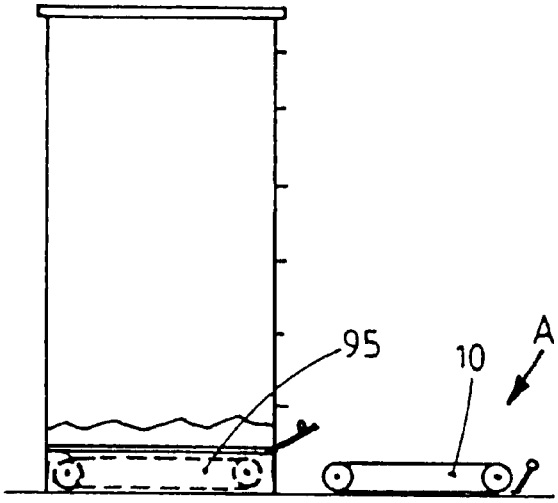
Figure 66:
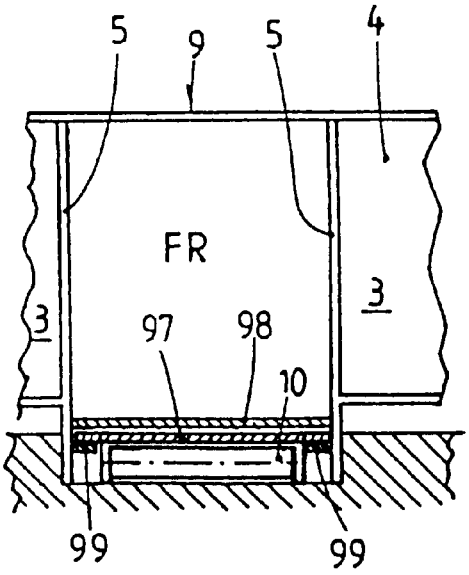
Figure 67:
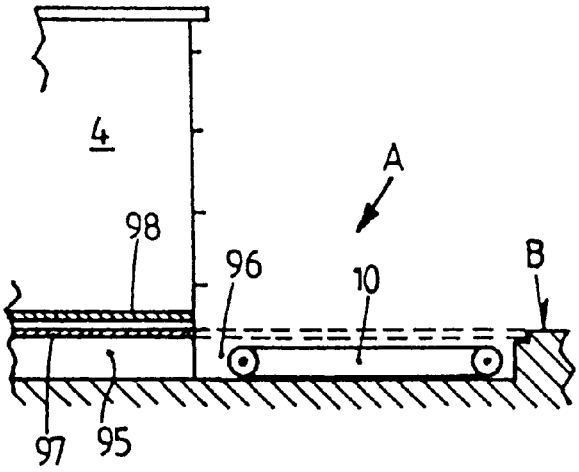
Figure 68:
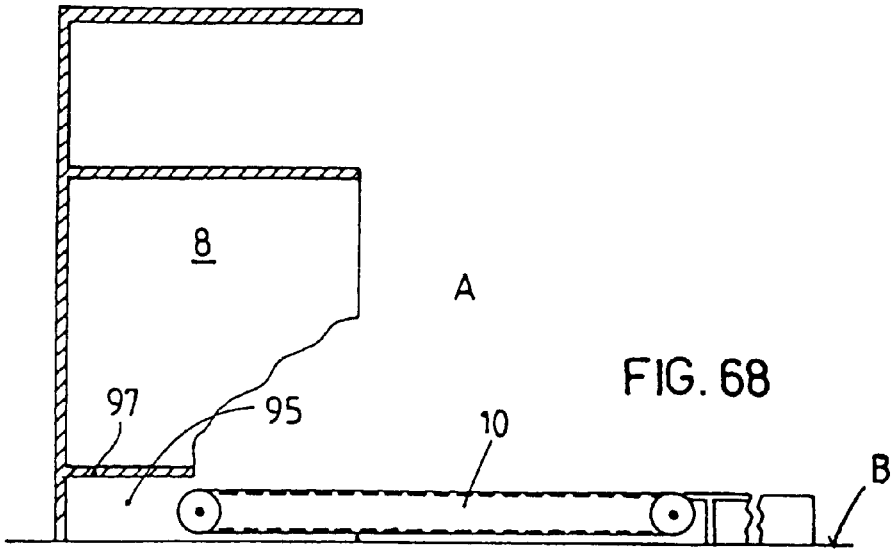
Figure 69:
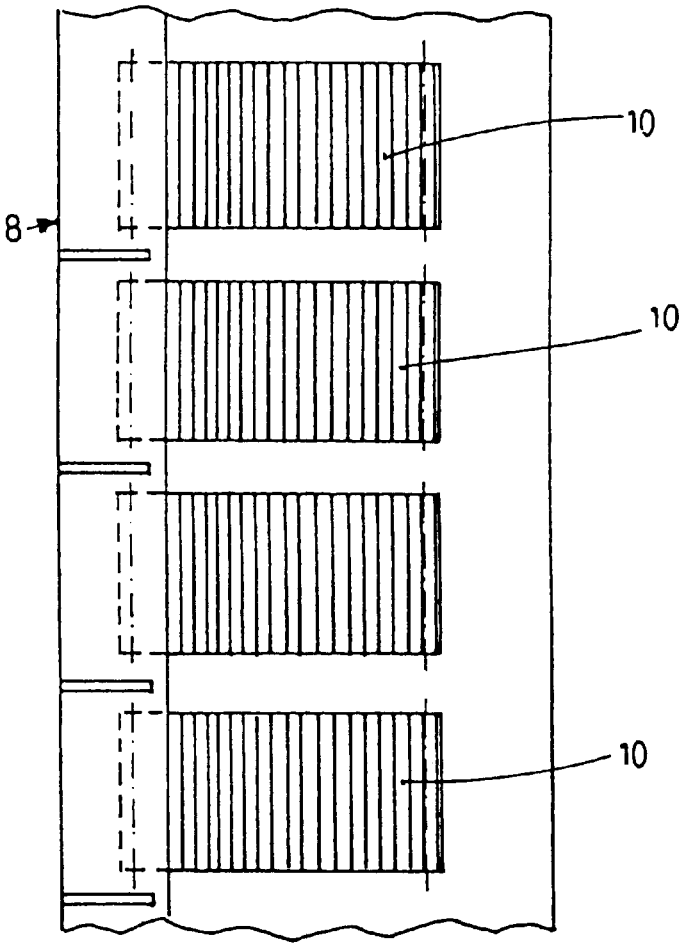

FIG. 3 is a cross section of the standing desk of FIG. 1 along the line A–A', FIG. 4 is a side view and partial sections of the treadmill exercising device of FIGS. 5 and 6, FIG. 5 is a front view and partial section of the treadmill exercising device, FIG. 6 is a top view with partial sections according to FIGS. 4 and 5, FIG. 7 is a detail at "Z" according to FIG. 1, FIG. 8 is a front view and partial section of a different standing desk, FIG. 9 is a side view with partial section according to FIG. 8, FIG. 10 is a detail at "W" according to FIG. 9, FIG. 11 is a detail at "V" according to FIG. 10, FIG. 12 is a front view of a writing desk, FIG. 13 is a side view with partial section according to FIG. 12, FIG. 14 is a front view according to FIG. 12 with a different movement kinematics of the treadmill exercising device, FIG. 15 is a top view according to FIG. 14, FIG. 16 is a detail "U" according to FIG. 12, FIG. 17 is a front view of a different desk with a different movement kinematics of the treadmill exercising device, FIG. 18 is a partial view according to FIG. 18, FIG. 19 is an illustration of the movement kinematics of FIGS. 17 and 18, FIG. 20 is a front view of a different desk with a different movement kinematics of the treadmill exercising device, FIG. 21 is a horizontal cross section according to FIG. 20, FIG. 22 is a detail at "T", FIG. 23 is a movement kinematics according to FIG. 22, FIG. 24 is a partial view according to FIG. 23, FIG. 25 is a detail at "S" according to FIG. 24, FIG. 26 is a front view of the writing desk with modified movement kinematics, FIG. 27 is a top view according to FIG. 26, FIG. 28 is a front view of a different desk with modified movement kinematics, FIG. 29 is a top view with partial section according to FIG. 28, FIG. 30 is a side view according to FIG. 28, FIG. 31 is a detail at "R" according to FIG. 29, FIG. 32 is a detail at "Q" according to FIG. 31, FIG. 33 is a partial section and side view of the writing desk of FIG. 28 with modified movement kinematics, FIG. 34 is a detail "P" in FIG. 36, FIG. 35 is a cross section taken along the line C–C' of FIG. 34, FIG. 36 is a partial view of FIG. 33 with further modified movement kinematics, FIG. 37 is a partial front view of FIG. 28 with further modified movement kinematics, FIG. 38 is a side view with partial section according to FIG. 37, FIG. 39 is an illustration of the movement kinematics according to FIG. 37, FIG. 40 is a front view of a writing desk with the treadmill exercising device in a rest position on a rear wall, FIG. 41 is a side view of the movement kinematics, FIG. 42 is a partial side section according to FIGS. 40/41, FIG. 43 is a detail according to FIG. 42, FIG. 44 is a front view of a modified embodiment of a writing desk according to FIG. 40, FIG. 45 is a side view of the movement kinematics according to FIG. 44, FIG. 46 is a top view of the illustration of FIG. 45, FIG. 47 is a side view of a modification of the embodiment of FIG. 45, FIG. 48 is a detail of an embodiment according to FIG. 47, FIG. 49 is a detail of a another embodiment according to FIG. 47, FIG. 50 is a detail according to FIG. 49, FIG. 51 is a detail of a another embodiment according to FIG. 47, FIG. 52 is a detail of a treadmill exercising device, FIG. 53 is a detail of a treadmill exercising device according to FIG. 4, FIG. 54 is a detail according to FIG. 53, FIG. 55 is a detail according to FIG. 53, FIG. 56 is a detail of a treadmill exercising device according to FIG. 53, FIG. 57 is a detail of a treadmill exercising device according to FIG. 53, FIG. 58 is a detail of a treadmill exercising device according to FIG. 3, FIG. 59 is a detail of the device for raising and tilting the table top or work bench top of office and work furniture according to FIGS. 1, 2, 8, 9, 12, 17, 20, 26, 28, 40, 44, FIG. 60 is a further modified detail according to FIG. 59, FIG. 61 is a further modified detail according to FIG. 59, FIG. 62 is a detail according to FIG. 61 in operating position, FIG. 63 is a top view of a detail according to FIG. 61, FIG. 64 is a front view of a desk, similar to FIGS. 1 to 3 and 8 to 10, modified for sliding underneath a table top, FIG. 65 is a side view and partial section of the desk of FIG. 64, FIG. 66 is a partial front section of office and work furniture according to FIG. 12, FIG. 67 is a partial side view according to FIG. 66, FIG. 68 is a partial side view of an office desk in the form of a counter for public transactions, FIG. 69 is a top view of the counter for public transactions of FIG. 68.

Referring now to FIGS. 1 to 3 and 8 to 11, there are shown embodiments of standing desks 1 according to the invention with table tops or work bench tops 9. The table top or work bench top of the standing desks of FIGS. 1, 2 and 8, 9 can be raised, lowered and tilted. FIG. 1 shows a partial front section of the standing desk 1, wherein the link conveyor belt 11 of the exercise device is shown in the rest position. FIG. 2 shows the exercise device in the operating position 2 and pulled out towards the workplace. The numeral 14 references the side cover of the conveyor belt, and the numeral 5 the latchable and releasable locking device.

The essential design features of the of the treadmill exercising device 10 are shown in FIGS. 4 to 7. The numeral 12 references a support frame and the numeral 11 references the continuous conveyor belt which is guided over two deflection rolls 13 supported in the frame 12 and which can constructed from rubber or from lamellar elements. The support frame is laterally enclosed by a side cover 14 and comprises slider or roller elements 24 which facilitate moving the treadmill exercising device 10 on the floor B.

At least one of the deflection rolls 13 of the treadmill exercising device 10 can be provided with a motor drive, as is shown in FIGS. 4 and 6. The drive comprises an electric motor 15 disposed within the support frame 12 and a V-belt or a similar endless traction means as transmission device 16 for transmitting the torque to the drive shaft 17 of the deflection roll 13.

In the region between the deflection rolls 13 of the upper run of the conveyor belt 11, the device is advantageously provided with support elements for supporting the conveyor belt 11, which preferably has a non-crush flat support surface with a slideway lining. To improve the belt movement, rotatable rollers 7 can be placed across the area and supported on the support surface between the support elements 6, as is shown in FIG. 7. The RPM of the motor drive is preferably adjustable. The slider or roller elements 24 mentioned above are supported on the support frame 12 which is laterally enclosed by the side covers 14.

FIGS. 8 to 10 illustrate another embodiment of the office and work furniture in the form of a standing desk 1 with a tiltable table top or work bench top 9 which is also adjustable in height. The treadmill exercising device 10 can be pulled or moved out of the rest position P1 inside the standing desk 1 into the operation position P2 in front of the furniture 1 by moving the device 10 on the floor B either manually or by remote control with the help of a horizontal displacement device 25 which is driven by a motor 25 and connected to the treadmill exercising device 10.

According to FIGS. 9 and 11, the horizontal displacement device consists of toothed rails 27 attached to both sides of the standing desk 1 and cooperating with toothed pinions 26 supported by the treadmill exercising device 10 and driven by the motor 25.

In a modified embodiment depicted in FIG. 10, the horizontal displacement device is a continuous traction means 28 which is guided on both sides over deflection rolls 29 and driven by a motor 25, with the treadmill exercising device 10 releasably connected to the lower run of the continuous traction means through a rib 30. With this connection to the continuous traction means 28, the treadmill exercising device 10 can be moved from the rest position P1 into the operating position P2 and back. In another embodiment relating to horizontal displacement, the horizontal displacement device is a linear motor or a hydraulic piston actuator. FIGS. 12 to 51 which will be described hereinafter, relate to a group of office and work furniture in the form of a writing desk 2 which can also include a table top or work bench top 9 which is either fixed or which can be raised and lowered as well as tilted; the office and work furniture can also comprise a foot space FR and a container 3 disposed on one side or on both sides of the foot space FR.

In some of these writing desks, the treadmill exercising device 10 can be pulled out along the floor B from its rest position P1 underneath a container 3 where the device is guided in lateral guides 32 in the bottom region BU, by initially displacing the treadmill exercising device 10 into a ready position P3 and by subsequently moving the treadmill exercising device 10 transversely from the ready position P3 into the operating position P2 midway in front of the table top or work bench top 9, as illustrated in FIGS. 12 to 15. FIG. 16 shows details of the embodiment of the treadmill exercising device 10 with the continuous conveyor belt 11 and the roller elements 24 arranged on the support frame 12.

With this arrangement and design, the user of the treadmill exercising device adapted for the writing desk can move the device 10 from the rest position P1 into the operating position P2 with two simple manipulations.

In an improved embodiment illustrated in FIGS. 16 to 19, the treadmill exercising device 10 can be moved transversely in the lateral guides 32 from the rest position P1 into a ready position P3 within the foot space FR with the help of a transverse displacement device 35 which is driven by motors 33, whereafter the treadmill exercising device is moved longitudinally from the ready position P3 into the operating position P2 with the help of a longitudinally displacement device 36 which is driven by motors 34.

With the motor-driven operation of the two sequential translations which can be remotely controlled, the user who is working, for example, at the writing desk, is able—depending on the position and the type of work—to move the treadmill exercising device 10 into the operating position P2 at the workplace and to exercise his/her legs while standing up. If the user decides to continue the work, then the user can likewise adjust the height-adjustable table top or work bench top 9 to the appropriate height and/or tilt with a motor drive.

In another significant modification of this embodiment, as illustrated in FIGS. 20 to 25, the treadmill exercising device 10 can be tilted with the help of a tilting device by 180° about a vertical axis X from its rest position P1 underneath the container 3 in the bottom region BU into an operating position P2, as depicted in FIGS. 21 and 22. The positions P1 and P2 of the treadmill exercising device 10 can be seen in FIG. 21. It is evident from FIG. 22 that the device is supported by the tilt elbow 44 underneath the container 3 for rotation about the X axis.

In another more preferred embodiment, the treadmill exercising device 10 can be secured against rotation from its rest position P1 underneath the containers by being connected to a tiltable vertical drive shaft 38 which is rotatably secured to the writing desk 2, as is illustrated in FIGS. 23 to 25. The drive shaft 38 is provided with a handle 39 so that the user can rotate the treadmill exercising device 10 into the operating position P2 from the workplace A.

For rotating the treadmill exercising device 10 with a motor by remote control, as illustrated in FIGS. 26/27, the drive shaft 38 can be driven by a tilt motor 40 through a transmission (not shown in FIGS. 26/27).

With this advantageous and simple design, the device can be moved into the operating position P2 with only one manipulation. Remote control by pushing a button is also feasible.

Another preferred embodiment of the office and work furniture in the form of a writing desk, with a foot space FR and a container 3 disposed on one side or on both sides of the foot space FR, is illustrated in FIGS. 28 to 39. Here, the treadmill exercising device 10 can be moved from its rest position P1 which is a vertical receiving pocket 41 disposed on the side of the container 3 facing the foot space FR, into the operating position P2 by pulling the treadmill exercising device 10 out towards the front and rotating the treadmill exercising device 10 about 90° towards the floor B. With this solution, the treadmill exercising device 10 is advantageously unobtrusively placed vertically in its rest position P1 on the side of the foot space FR, from where the device can be pulled out and rotated with two manipulations.

Referring now to FIGS. 31 and 32, the support frame of the treadmill exercising device 10 is here advantageously connected to a sliding bushing 43 which can slide on a guide rod 42 secured to the writing desk 2 and which can be moved from the rest position P1 in the receiving pocket 41 along the floor B through a roller arrangement 45; the sliding bushing 43 can then be rotated together with the treadmill exercising device 10 from the vertical rest position into the horizontal operating position on the floor B to assume the operating position P2.

This design significantly simplifies the operation of moving the treadmill exercising device 10 into the operating position.

In yet another improved embodiment of the office and work furniture, a motor-driven pinion 50 which is secured in a housing 51 on the sliding bushing 43, meshes with teeth 49 disposed on the guide rod 42. In this way, the treadmill exercising device 10 can be automatically pulled out of the receiving pocket 41 by remote control with the help of the pinion motor 52. In addition, the treadmill exercising device can also be automatically rotated from the pulled-out vertical position into the horizontal position on the floor B; for this purpose, the guide rod 42—see FIGS. 34, 35 and 36—has a square or rectangular profile and is supported by the joint 48 on the wall of the receiving pocket for pivoting together with the treadmill exercising device 10 about the longitudinal axis. This is accomplished with the help of the lever 47 which is connected to the guide rod 42 and actuated and controlled by the remotely controlled hydraulic drive 46, as is indicated in FIGS. 33 and 36. A linear motor can be employed instead of a hydraulic drive, i.e. a piston/cylinder unit 46.

In yet another modification, a traction mechanism 53 which is driven by a motor 54, can engage the lever 47 which is connected to the guide rod 42, as illustrated in FIGS. 37 to 39. The traction mechanism 53 can be a cable or a tooth-type chain or a link chain drive. As a result of this design, the treadmill exercising device 10 can be remotely operated from the writing desk by pushing a button.

In still another modified embodiment of the office and work furniture in the form of a writing desk 2 with a table top or work bench top 9, the treadmill exercising device 10 in the rest position P1 is oriented substantially vertical or slightly tilted from the vertical direction and located in the region of the foot space FR facing away from the workplace A, i.e. in the area of the rear wall of the writing desk 2, as is illustrated in FIGS. 40 and 41. The treadmill exercising device 10 is placed into the operating position P2 by moving the device 10 downwardly towards the front along guides oriented parallel to a Y-axis which extends diagonally downwardly towards the front, until the device 10 rests on the floor in the operating position P2.

In yet another advantageous embodiment, both sides of the treadmill exercising device 10 are connected in the region of the upper deflection roll 13 to respective guide bushings 56 which are slideably guided by respective rigid self-supporting rods 55 arranged on the writing desk 2 and forming the y axis, as is illustrated in FIGS. 42 and 43.

In a motor-driven and remotely controlled embodiment, both sides of the treadmill exercising device 10 can be connected in the region of a deflection rolls 13 to respective traction means 57 which can be spooled on both sides onto reels 58 disposed on a common shaft 59 and driven by the motor(s) 60. This drive arrangement can be located unobtrusively in the free space FR at the top of the rear face plate of the writing desk 2, as illustrated in FIGS. 44 to 46.

The traction means 57 can be cables which can be wound, as well as other traction means or belts as illustrated in FIG. 47. In a modified embodiment depicted in FIG. 48, link chains and toothed traction means 62 which are motor-driven by toothed pinions 63, can also be used, as is illustrated in FIGS. 47 and 48, to lower and place the treadmill exercising device 10 from the rest position P1 into the operating position P2 on the floor B.

In still another advantageous and simple embodiment illustrated in FIGS. 49 and 50, a continuous traction means 66 is secured to the guide bushings and guided via guide rolls and looped multiple times around the motorized drive rolls 67 for transferring the torque. The drive rolls 67 are operatively connected to the drive motor 60 via a shaft.

In another advantageous embodiment of the device according to FIG. 51, the Y axis can be formed by a ball spindle 68 wherein the adjusting screw 69 of the ball spindle 68 is connected to the treadmill exercising device 10 in the region of the axis of a deflection roll 13; the ball spindle 68 is also connected to a drive motor 60 via a transmission 70. This design advantageously requires only minor maintenance and rarely experiences malfunctions. Only a very short time is required for adjustments.

The treadmill exercising device 10 best suited for the office and work furniture of the invention should preferably be light-weight and still have advantageous properties for the intended use. In a particularly preferred embodiment illustrated in FIG. 52, the drive motor 75 of the device is located inside one of the deflection rolls 13, driving the deflection rolls 13 directly. The stator 80 is advantageously secured to the support frame 12 through a stationary stator bolt 76, whereas the rotor shaft 78, to prevent rotation, is secured to a clutch drive ring 79 which is clamped inside the cylindrical inner space 81 of the roll 13.

In a particularly advantageous embodiment of the treadmill exercising device 10 adapted for use at a workplace, the device 10 can be raised continuously or step-wise—as indicated in FIG. 53—into an inclined position having an angle of up to 15° by raising the end E pointing in the running direction.

The end E of the treadmill exercising device 10 pointing in the running direction can advantageously be raised by articulated, rotatably supported threaded spindles 83 provided on both sides of the treadmill exercising device 10 and supported on the floor B, wherein the spindles 83 can be rotated either manually or with the help of a motor and are provided with threaded nuts 84 which are flexibly connected to the support frame 12, as is illustrated in FIGS. 83 and 84.

In another embodiment, the end E of the treadmill exercising device 10 pointing in the running direction can advantageously be raised by a rack/pinion assembly having toothed racks 85 which are arranged on both sides of the treadmill exercising device and are supported on the floor B, and manually operated or motor-driven pinion units 86 which are flexibly supported on the support frame 12 and are guided longitudinally on the toothed racks 85.

According to another feature of the invention, double levers 87 are pivotally supported on both sides of the support frame 12, with the upper lever arms of the double levers 87 flexibly coupled to hydraulic piston actuators or linear motors 88, and with the lower lever arms of the double levers 87 supported on the floor B by slider elements 89, as illustrated in FIG. 56.

A similar arrangement is shown in FIG. 57, which includes eccentric support rolls 90 which are supported on the floor B and are rotatably supported on both sides of the support frame 12 and provided with an upwardly pointing lever 91 with a handle 92 for adjusting the height of that end E of the treadmill exercising device 10 which points in the running direction. A slightly modified embodiment is depicted in FIG. 58, wherein the eccentric support rolls are in the form of discs 93 with at least three polygonal support surfaces 94.

An essential functional requirement for the treadmill exercising device of the invention is that the table top or work bench top 9 is adjustable in height and/or can be tilted with respect to the horizontal direction. The user of the treadmill exercising device at the workplace must be able to continue his/her work even when running on the moving band 11, or must at least be able to review documents.

For adjusting the height and also tilting the table top or work bench top 9 of a piece of office and work furniture of the invention, both sides of the table top or work bench top 9 are connected through a linkage 103 to respective toothed lifting rods 100 which cooperate with respective pinions 101 and a lifting motors 102 driving the pinions 101. In another modified embodiment, both sides of the table top or work bench top 9 are connected through linkages 103 to respective piston rods 104 of hydraulic piston actuators 105. Alternatively, both sides of the table top or work bench top 9 can be connected through linkages 103 to respective spindle drives 107 and the lifting motors 102 associated with the spindle drives 107.

Referring now to FIGS. 64 and 65, there is shown a desk which can be used as a standing desk, as a filing cabinet, and in particular also as a container adapted to be placed underneath a desk top, wherein a treadmill exercising device 10 can be removeably inserted in the lower region BU of the free space FR.

In a particularly advantageous embodiment of the invention depicted in FIGS. 66 and 67, the office and work furniture has the form of a writing desk 4 comprising a foot plate 98 disposed underneath the foot space FR and enclosing the bottom side of the foot space FR, wherein the walls 5 of the writing desk 4 which bound both sides of the container 3 to the inside, extend into a recessed space 96 below the floor level and comprise guides 99 for moving a cover plate 97 from the inside to the outside.

Such a design is most advantageous if a treadmill exercising device 10 is permanently installed in the recessed space 96 which can be covered, if necessary.

In a most preferred embodiment, the office and work furniture is in the form of a counter 8 for public transactions, wherein the workspace of the counter is arranged in the form of a counter front and individual counter spaces, as illustrated in FIGS. 68 and 69, wherein in the lower section of each counter space a cover plate 97 partitions off a free space 95 adapted to partially receive the treadmill exercising device 10 placed on the floor in the area of each workspace A.

What is claimed is:

1. A furniture article, comprising:

a frame supported on a floor;

a table top supported by said frame; and an exercising device formed as a moveable continuous conveyor belt, said exercising device including at least one support member having at least one of slider and roller elements, two deflection rollers supported in said support member, and a continuous convevor belt made of a resilient material and guided by the deflection rollers, said exercising device having a rest position located within a three-dimensional space enclosed by said frame and said table top and an operating position different from said rest position, said operating position located on the floor outside said three-dimensional space, wherein said exercising device can be at least one of moved and tilted from the rest position into the operating position and locked in the operating position.

2. The furniture article of claim 1, wherein the exercising device includes at least one support member having at least one of slider and roller elements, two deflection rollers supported in said support member, and a continuous conveyor belt made of resilient material and guided by the deflection rollers.

3. The furniture article according to claim 1, and further comprising a motor drive assembly for driving at least one of the deflection rollers.

4. The furniture article of claim 3, wherein the motor drive assembly includes an electric motor disposed in the support member and a transmission coupled to the motor for transmitting a torque to the deflection roller.

5. The furniture article of claim 3, wherein the motor drive assembly is disposed in the deflection roller and drives directly the deflection roller.

6. The furniture article of claim 5, wherein the motor drive assembly includes a stator which is secured to the support member, and a rotor which is disposed inside the deflection roller and non-rotatably secured inside the deflection roller through a clutch ring.

7. The furniture article according to claim 1, wherein an end of the exercising device can be one of raised and lowered with respect to the floor in one of a continuous or step-wise fashion.

8. The furniture article of claim 7, wherein the end of the exercising device that can be raised or lowered includes a plurality of rotatable threaded spindles supported on the floor, said threaded spindles cooperating with threaded nuts connected to the support member, wherein the end of the exercising device is raised or lowered by rotating the threaded spindles.

9. The furniture article of claim 7, wherein the end of the exercising device that can be raised or lowered includes a rack/pinion assembly having a plurality of toothed racks, which are supported on the floor, and corresponding pinions, which are flexibly supported on the support member and cooperate with the toothed racks.

10. The furniture article of claim 7, wherein the end of the exercising device that can be raised or lowered includes dual levers pivotally supported on sides of the support member and having upper and lower lever arms, with the upper lever arms flexibly coupled to one of a hydraulic piston actuator and a linear motor and the lower lever arms further including slider elements supported on the floor.

11. The furniture article of claim 7, wherein the end of the exercising device that can be raised or lowered includes eccentric support rollers, which include a handle and are rotatably secured to sides of the support member and supported by the floor.

12. The furniture article of claim 11, wherein the eccentric support rollers have the shape of a polygon with at least three faces.

13. The furniture article of claim 1, and further comprising a horizontal displacement drive, which is connected to the exercising device, and a motor controlled by a remote control for moving the horizontal displacement drive and thereby the exercising device between the rest position and the operating position.

14. The furniture article of claim 13, wherein the horizontal displacement drive includes a plurality of toothed rails and motor-driven pinions, said motor-driven pinions secured to the exercising device and engaging with the toothed rails.

15. The furniture article of claim 13, wherein the horizontal displacement drive includes a plurality of deflection rollers and motor-driven continuous traction means guided over said deflection rollers, and wherein the exercising device is releasably connected to a lower run of the continuous traction means through a rib.

16. The furniture article of claim 15, wherein the horizontal displacement drive includes at least one of a linear motor and a hydraulic piston actuator.

17. The furniture article of claim 1, further comprising at least one repository arranged to a side of the three-dimensional space, said rest position located underneath the repository, wherein the exercising device is moved sequentially from the rest position into the operating position by first displacing the exercising device along a first path to an intermediate position and then moving the exercising device along a second path oriented transversely to the first path from the intermediate position to the operating position aligned with the center of the table top.

18. The furniture article of claim 17, and further comprising a transverse displacement drive driven by a first motor for moving the exercising device transversely along the first path and a longitudinal displacement drive driven by a second motor for moving the exercising device longitudinally along the second path.

19. A furniture article comprising:

a frame supported on a floor;

a table top supported by said frame;

an exercising device formed as a moveable continuous conveyor belt; and rotation means for rotating the exercising device by 180° about a vertical axis from the rest position into the operating position, said exercising device having a rest position located within a three-dimensional space enclosed by said frame and said table top and an operating position different from said rest position, said operating position located on the floor outside said three-dimensional space, wherein said exercising device can be at least one of moved and tilted from the rest position into the operating position and locked in the operating position.

20. The furniture article of claim 19, wherein the rotation means includes a vertical drive shaft and a handle, said vertical drive shaft being rotatably supported in the furniture article and non-rotatably connected to the exercising device, and wherein the exercising device can be rotated with the handle about an angle of approximately 180° between the rest position and the operating position and vice versa.

21. The furniture article of claim 20, wherein the rotation means includes a motor assembly with a transmission for rotating the exercising device.

22. The furniture article according to claim 1, and further comprising at least one repository having a vertical receiving pocket disposed on a side of the repository and defining the rest position, wherein the exercising device can be moved from the rest position into the operating position by pulling the exercising device out towards a front of the furniture article and then rotating the exercising device about 90° towards the floor.

23. The furniture article of claim 22, and further comprising a guide rod secured to the furniture article; and a sliding bushing adapted to slide on the guide rod and having rollers for movably supporting the sliding bushing on the floor, wherein the sliding bushing is connected to the support member for rotation with the exercising device from the vertical rest position into the operating position.

24. The furniture article of claim 23, and further comprising a motor-driven pinion disposed on the sliding bushing; teeth disposed on the guide rod and meshing with the pinion; a lever connected to the guide rod; and a linear motor or hydraulic drive engaging with the lever, wherein the guide rod is rotatably supported in a lower section of the receiving pocket for rotation effected by the lever and the linear motor or hydraulic drive from the vertical rest position into the horizontal operating position.

25. The furniture article of claim 24, and further comprising a motor-driven traction mechanism engaging with the lever.

26. The furniture article of claim 25, wherein the traction mechanism is a toothed chain or a link chain drive.

27. The furniture article according to claim 1, and further comprising guide members oriented at an angle with respect to a vertical direction, wherein the rest position is substantially vertical or slightly tilted from the vertical direction and the exercising device is moved into the operating position by sliding along the guide members.

28. The furniture article of claim 27, and further comprising guide bushings connected to the exercising device in the region of the deflection rollers, wherein the guide bushings are slideably guided on the guide members.

29. The furniture article of claim 27, and further comprising a motor-driven shaft; reels disposed on the shaft; and traction means connected to the exercising device in the region of the deflection rollers and adapted to be wound onto the reels.

30. The furniture article of claim 28, and further comprising link chains or toothed traction means and motor-driven toothed drive wheels engaging with the link chains or toothed traction means for moving the exercising device from the rest position into the operating position.

31. The furniture article of claim 30, wherein the link chains or toothed traction means are secured to the guide bushings and directed to the toothed drive wheels over guide rolls.

32. The furniture article of claim 28, and further comprising at least one motor-driven roll; and continuous traction means secured to the guide bushings and directed over guide rolls, wherein the traction means are looped around the roll multiple times for transmitting a motor torque to the traction means.

33. The furniture article of claim 27, wherein the guide member has the form of a motor-driven ball spindle and wherein an adjustment nut of the ball spindle is connected to the exercising device in the region of one of the deflection rollers.

34. The furniture article of claim 1, wherein said table top is in the form of a standing desk.

35. A furniture article, comprising:

a frame supported on a floor;

a table top in the form of a standing desk and supported by said frame; and an exercising device formed as a moveable continuous conveyor belt, said exercising device including at least one support member having at least one of slider and roller elements, two deflection rollers supported in said support member, and a continuous conveyor belt made of a resilient material and guided by the deflection rollers, said exercising device having a rest position located within a three-dimensional space enclosed by said frame and said table top and an operating position different from said rest position, said operating position located on the floor outside said three-dimensional space, wherein said exercising device can be at least one of moved and tilted from the rest position into the operating position and locked in the operating position, and wherein the table top is at least one of adjustable in height and tiltable relative to a horizontal plane.

36. The furniture article of claim 35, and further comprising at least one toothed lifting rod; a linkage connecting the table top and the at least one lifting rod; and at least one motor-driven pinion engaging with a respective lifting rod for adjusting the height of the table top or tilting the table top.

37. The furniture article of claim 35, and further comprising at least one piston rod; a linkage connecting the table top and the at least one piston rod; and at least one hydraulic piston actuator coupled to the piston rod for adjusting the height of the table top or tilting the table top.

38. The furniture article of claim 35, and further comprising at least one spindle drive; a linkage connecting the table top and the at least one spindle drive; and at least one lifting motor cooperating with the spindle drive for adjusting the height of the table top or tilting the table top.

39. The furniture article of claim 1, and further comprising repositories having side walls extending substantially to the floor; a foot plate substantially parallel to the floor and connecting the side walls; and a cover plate disposed between the foot plate and the floor, wherein the side walls form guides for guiding movement of the cover plate from the rest position to substantially the operating position of the exercising device.

40. A furniture article comprising:

a frame supported on a floor;

a table top supported by said frame; and an exercising device formed as a moveable continuous conveyor belt, said exercising device including at least one support member having at least one of slider and roller elements, two deflection rollers supported in said support member, and a continuous conveyor belt made of a resilient material and guided by the deflection rollers, said exercising device having a rest position located within a three-dimensional space enclosed by said frame and said table top and an operating position different from said rest position, said operating position located on the floor outside said three-dimensional space, wherein said exercising device can be at least one of moved and tilted from the rest position into the operating position and locked in the operating position, wherein the furniture article is in the form of a counter adapted for transacting business with the public, the counter comprising a counter front, a plurality of wall members for separating individual counter spaces, a cover plate disposed in the counter space and in cooperation with the wall members and the floor defining a receiving space, wherein the receiving space at least partially receives the exercising device which is placed on the floor.

* * * * *